US012667174B2

(12) United States Patent
Ogawa

(10) Patent No.: US 12,667,174 B2
(45) Date of Patent: Jun. 30, 2026

(54) BELT RETRACTOR, BAG USING BELT RETRACTOR, AND HELMET

(71) Applicant: EDISON LAB. CO., LTD., Kanagawa (JP)

(72) Inventor: Kota Ogawa, Kanagawa (JP)

(73) Assignee: EDISON LAB. CO., LTD., Kanagawa (JP)

( * ) Notice: Subject to any disclaimer, the term of this patent is extended or adjusted under 35 U.S.C. 154(b) by 77 days.

(21) Appl. No.: 18/292,260

(22) PCT Filed: Dec. 10, 2021

(86) PCT No.: PCT/JP2021/045720
§ 371 (c)(1),
(2) Date: Jan. 25, 2024

(87) PCT Pub. No.: WO2023/007762
PCT Pub. Date: Feb. 2, 2023

(65) Prior Publication Data

US 2024/0341434 A1 Oct. 17, 2024

(30) Foreign Application Priority Data

Jul. 26, 2021 (JP) ..... 2021-121152

(51) Int. Cl.
*A45C 13/30* (2006.01)
*B65H 75/44* (2006.01)

(52) U.S. Cl.
CPC ..... *A45C 13/30* (2013.01); *B65H 75/4449* (2013.01)

(58) Field of Classification Search
CPC ..... A45C 13/10; A45C 13/30; B60R 22/44; B65H 75/28
(Continued)

(56) References Cited

U.S. PATENT DOCUMENTS 3,198,300 A * 8/1965 Tuttle ..... A45F 3/02 150/108
5,027,874 A * 7/1991 Gazzola ..... A45C 13/26 150/108
(Continued)

FOREIGN PATENT DOCUMENTS

CN 207322961 U 5/2018
EP 0787675 A2 * 8/1997 ..... B65H 75/44
(Continued)

OTHER PUBLICATIONS

English translation of Written Opinion (PCT/ISA/237) issued in PCT/JP2021/045720 mailed in Mar. 2022.
(Continued)

*Primary Examiner* — Emmanuel M Marcelo
*Assistant Examiner* — Ermia E. Melika
(74) *Attorney, Agent, or Firm* — CHEN YOSHIMURA LLP

(57) ABSTRACT

A belt retractor comprises: an outer member into which the strap belt can be inserted; core parts rotatably provided inside the outer member; and, an elastic member provided between the core parts and the outer member at a position axially displaced with respect to a belt winding part in the core parts, the core parts having an insertion part into which the strap belt is inserted, and the strap belt winding around the core parts and being stored between the core parts and the outer member by the core parts rotating relative to the outer member according to the bias of the elastic member with the insertion part gripping the belt.

13 Claims, 12 Drawing Sheets

(58) Field of Classification Search
USPC ..... 242/371, 587.2
See application file for complete search history.

(56) References Cited

U.S. PATENT DOCUMENTS

| | | | | |
|---|---|---|---|---|
| 5,294,029 | A * | 3/1994 | Shimura | A45C 5/00 242/379.2 |
| 5,897,039 | A * | 4/1999 | Swenke | A45F 5/004 150/108 |
| 6,053,381 | A * | 4/2000 | Fahl | A45F 3/047 150/108 |
| 6,616,080 | B1 | 9/2003 | Edwards et al. | |
| 8,123,092 | B2 * | 2/2012 | Krulik | A45C 13/30 150/108 |
| 9,730,507 | B2 * | 8/2017 | Wendler | A45F 3/02 |
| 9,908,454 | B1 * | 3/2018 | Waters, Jr. | B60P 7/0846 |
| 12,233,294 | B2 * | 2/2025 | Patton | A62B 35/0025 |
| 2003/0010861 | A1 * | 1/2003 | Tsan | A45F 3/02 242/385.3 |
| 2003/0015563 | A1 * | 1/2003 | Vigny | A45F 3/04 224/652 |
| 2007/0170295 | A1 * | 7/2007 | Breeden | B60D 1/18 242/388.1 |
| 2017/0369274 | A1 * | 12/2017 | Joyner | A45C 13/10 |

FOREIGN PATENT DOCUMENTS

| | | | | |
|---|---|---|---|---|
| EP | 2378911 | B1 * | 5/2014 | A63B 71/0622 |
| EP | 2592964 | B1 * | 8/2016 | A45F 3/14 |
| JP | S59-15507 | A | 1/1984 | |
| JP | H4-66919 | U | 6/1992 | |
| JP | 2584362 | Y2 * | 10/1998 | |
| JP | 2002-544093 | A | 12/2002 | |
| JP | 2006-043233 | A | 2/2006 | |
| JP | 2008-43719 | A | 2/2008 | |

OTHER PUBLICATIONS

International Search Report (ISR) issued in PCT/JP2021/045720 mailed in Mar. 2022.
Written Opinion (PCT/ISA/237) issued in PCT/JP2021/045720 mailed in Mar. 2022.

* cited by examiner

BELT RETRACTOR, BAG USING BELT RETRACTOR, AND HELMET

TECHNICAL FIELD

This invention relates to a retractor for winding up a belt, and to a bag and a helmet using the retractor.

BACKGROUND ART

Conventionally, bags and other pouches have a pouch portion for carrying small items and a strap portion for carrying said pouch portion by hand, shoulder, arm, etc. In particular, many shoulder bags, in which the strap is worn over one shoulder, and backpacks, in which the strap is worn over both shoulders, are equipped with an adjustment ring to adjust the length of the strap according to the body size. However, when the bag is lowered, this strap gets in the way and often gets caught unexpectedly on the protruding strap portion when the bag is placed on a train rack or the ground.

To avoid such problems, Patent Document 1 discloses a leisure bag equipped with a belt that is comfortable to wear and can be compactly stored.

RELATED ART DOCUMENT

Patent Document

Patent Document 1: Patent Publication No. 2006-043233

SUMMARY OF THE INVENTION

Problems to be Solved by the Invention

However, it is difficult to apply the technology of the leisure bag of Patent Document 1 to ordinary bags such as shoulder bags and backpacks.

The purpose of the present invention is to solve the above problem and to realize a bag and a strap retractor capable of retracting the strap.

Means for Solving the Problem

To solve the above problem, the belt retractor of the present invention has an outer member through which a strap belt can be inserted, a core member rotatably provided inside the outer member, and an elastic member provided between the core member and the outer member at a position axially offset from the belt winding portion in the core member. The core member has an insertion portion through which the strap belt is inserted, and the belt is wound around the core member and stored between the core member and the outer member when the core member rotates against the outer member in accordance with the force of the elastic member while the insertion portion grips the belt. The belt retractor is a belt retractor in which the strap belt is wound around the core member and stored between the core member and the outer member by rotating the core member against the outer member in accordance with the momentum of the outer member.

According to such a belt retractor, when the insertion portion grips the strap belt and the core member rotates against the outer member in accordance with the force of the elastic member, the strap belt is wound around the core member and stored between the core member and the outer member, thereby compactly accommodating the strap belt of the bag.

In particular, since the elastic member is provided between the core member and the outer member at a position axially offset from the belt winding portion in the core member, the core member can be made thin and the belt retractor can be made compact.

It is preferred that the elastic member is a spring wound around the same axis of rotation as the core member in a radial direction.

Thus, the size of the belt retractor in the direction of the axis of rotation can be kept small.

It is preferred that the outer member or the core member has a wall provided on the outer periphery of the spring at a certain distance from the axis of rotation, and that this wall prevents the spring from being touched from the outside.

This prevents the spring from being touched from the axial direction.

In addition, the belt retractor of the present invention has the core member having a cylinder member and a pin member provided inside the cylinder member and having the insertion portion, the pin member and the cylinder member having an engagement portion which can be engaged with each other and can be rotated with each other when the engagement in the engagement portion is released.

As a result, by rotating the pin member against the cylinder member in a disengaged state, the strap belt is wound around the pin member and stored between the pin member and the cylinder member, and the strap belt is fixed in the stored state by the engagement of the engagement portions in this state, that is, the strap belt is fixed in the stored state by the engagement of the engagement portions. Thus, the length of the strap belt can be adjusted.

Furthermore, it is desirable that the engagement portion comprises an engagement convex portion provided on the core member and an engagement concave portion provided on the cylinder member.

This allows the cylinder member and the pin member to be fixed to each other by engaging the engagement concave portion.

The cylinder member also has a cutout for the engagement convex portion to pass through, so that the engagement convex portion can pass through the cutout and enter the cylinder member.

It is desirable that the inner end of the spring be connected to the outer member and the outer end of the spring be connected to the cylinder member.

This allows the cylinder member to be urged against the outer member and the strap belt to be wound by the cylinder member.

The inner end of the spring may be moored to the pin member and the outer end of the spring may be moored to the outer member.

This allows the extended length of the belt to be adjusted by the force of the spring.

When the cylinder member is assembled into the outer member, there should be a gap in the axial direction between the outer member and the cylinder member that is larger than the dimension of the convex portion, and the outer member should have a pressing portion that urges the cylinder member in the direction in which the engaging portion engages the cylinder member.

This allows for easy adjustment of the length of the belt, as the pressure portion forces the cylinder member to maintain the engagement of the engagement portion, and when the cylinder member is moved against this force, the engagement is disengaged.

It is desirable that the pressure portion is provided by a slit in a portion of the outer member and has an elastic portion and a protruding portion.

This allows the pressing portion to be provided without the need for an additional member.

It is desirable for the pin member to be rotatably engaged with the outer member.

This prevents the pin member from being pulled out of the outer member.

It is desirable that the cylinder member and the outer member have an engagement portion which can be engaged with each other and are provided to be rotatable with each other when the engagement in the engagement portion is disengaged.

This prevents the pin member from being pulled out of the outer member.

It is desirable for the core member and the outer member to have an engagement portion that can engage with each other and to be capable of rotating with each other when the engagement in the engagement portion is disengaged, and to be united in the engaged state.

The rotation can be controlled by said engaging portion.

It is desirable that the engaging portions of the core member and the outer member are engaged by pressing pressure due to elastic deformation of the outer member, and by releasing the engagement against this pressing pressure, the core member is rotated against the outer member to wind the strap belt. The strap belt can be easily disengaged and wound from the outside.

It is desirable that the outer member has arms made of an elastic material, the core member is rotatably engaged with one end of the arms, the engagement portion is provided at the other end of the arms, and by applying pressure between both ends of the arms, the engagement portion is disengaged and the core member is rotatable.

It is desirable to have a disengagement mechanism for disengaging the engagement portions by moving the cylinder member in the axial direction against the force of the pressing portion.

The bag of the present invention has a backpack strap, and the belt retractor is provided on the backpack strap.

The bag of the present invention has a shoulder strap, and the belt retractor is provided on the shoulder strap.

The shoulder strap should have a shoulder pad at the center of the longitudinal direction, and the belt retractor is provided at the center of the longitudinal direction on both sides between the shoulder pads.

This allows for maximum storage of the shoulder straps.

The helmet of the present invention has a chin strap, and the belt retractor is provided on the chin strap.

DETAILED DESCRIPTION OF EMBODIMENTS

The embodiments of the belt retractor of the present invention will now be described.

Figure 1:
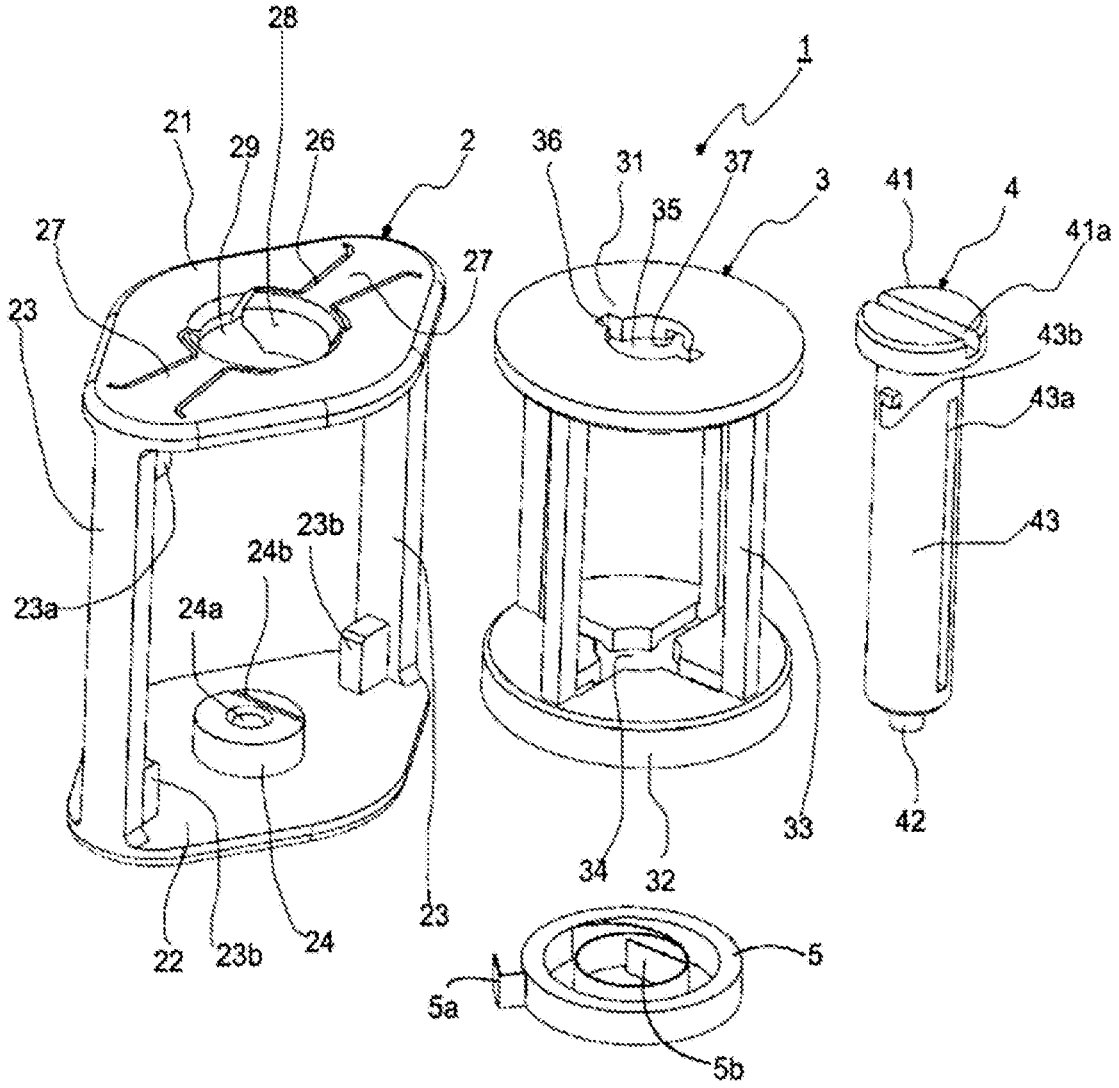
FIG. 1 is an exploded view of the belt retractor of the first embodiment.

FIG. 1 is an exploded view of the first embodiment of the seat belt retractor.

Figure 2:
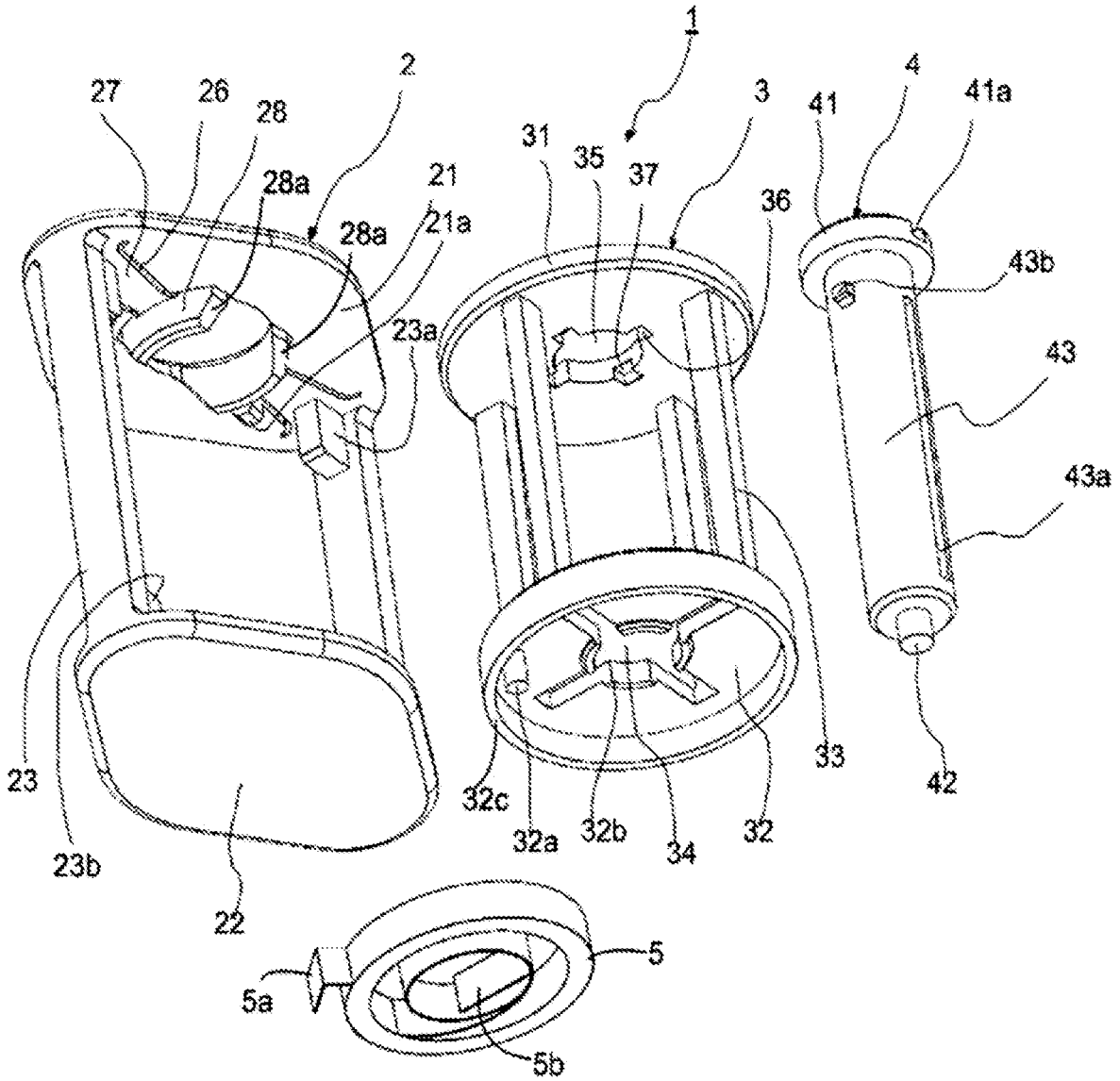
FIG. 2 is an exploded view of the belt retractor of FIG. 1 from another angle.

FIG. 2 is an exploded view of the belt retractor of FIG. 1 from another angle.

Figure 3:
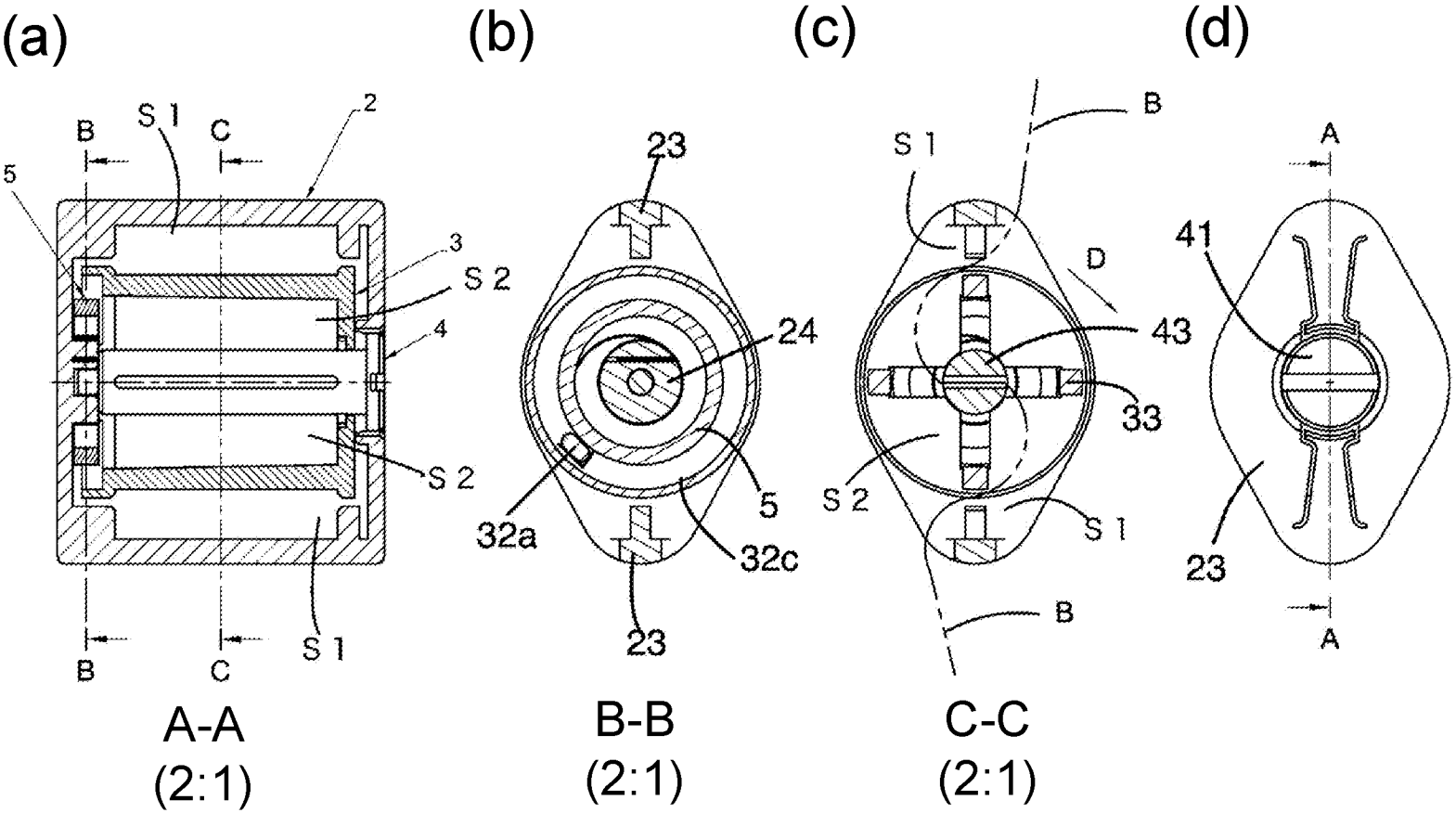
FIG. 3 is the assembled belt retractor of FIG. 1 is shown in (A) A-A section, (B) B-B section, (C) C-C section, and (D) top view.

FIG. 3 shows the assembled belt retractor of FIG. 1 in (A) A-A cross-sectional view, (B) B-B cross-sectional view, (C) C-C cross-sectional view, (D) plan view.

As shown in FIGS. 1~3, the belt retractor 1 of the first embodiment has an outer member 2, the cylinder member 3 and the pin member 4 as core members rotatably provided inside the outer member 2, the cylinder member 3 and the pin member 4 as core members, the cylinder member and the pin member 4 as elastic members forced to rotate against the outer member 2. The pin member 4, which is part of the core member, has a slit 43*a* as an insertion portion through which the belt B is inserted, and the cylinder member 3 and the pin member 4, which are part of the core member, rotate against the outer member 2 with the belt B being gripped by the belt B in accordance with the force of the spring 5, which is an elastic member, so that the belt B is wound around the cylinder member 3, which is part of the core member, and stored in the space S1 between the cylinder member 3 and the outer member 2. The spring 5 is stored in the core member at a position axially displaced from the pillar 33, which is the belt winding portion of the core member.

The pin member 4 and the cylinder member 3 have engagement convex portions 43*b* and engagement concave portions 37 as engagement portions which can be engaged with each other, and the pin member 4 is provided to be rotatable within the cylinder member 3 when the engagement in the engagement portions is disengaged.

When the pin member 4 and the cylinder member 3 are engaged, the belt is rotated against the force of the spring 5 in the direction of arrow D in FIG. 3, the belt is inserted at position B in FIG. 3, and when the hand is released, the cylinder member 3 is unwound by the restoring force of the spring 5, and the belt is wound around the cylinder member 3 and taken up, thereby allowing the belt to be stored from the bag and preventing the belt from hanging down.

Furthermore, by rotating the pin member 4 against the cylinder member 3 with the engagement concave portion 37 disengaged from the engagement concave portion 43*b*, the belt B is wound around the pin member 4 and contained in the space S2 in FIG. 3. In this state, the length of the belt B wound around the pin member 4 is determined by the engagement of the engagement convex portion 43*b* with the engagement concave portion 37. In this way, the extended length of the strap of the bag can be adjusted.

Figure 4:
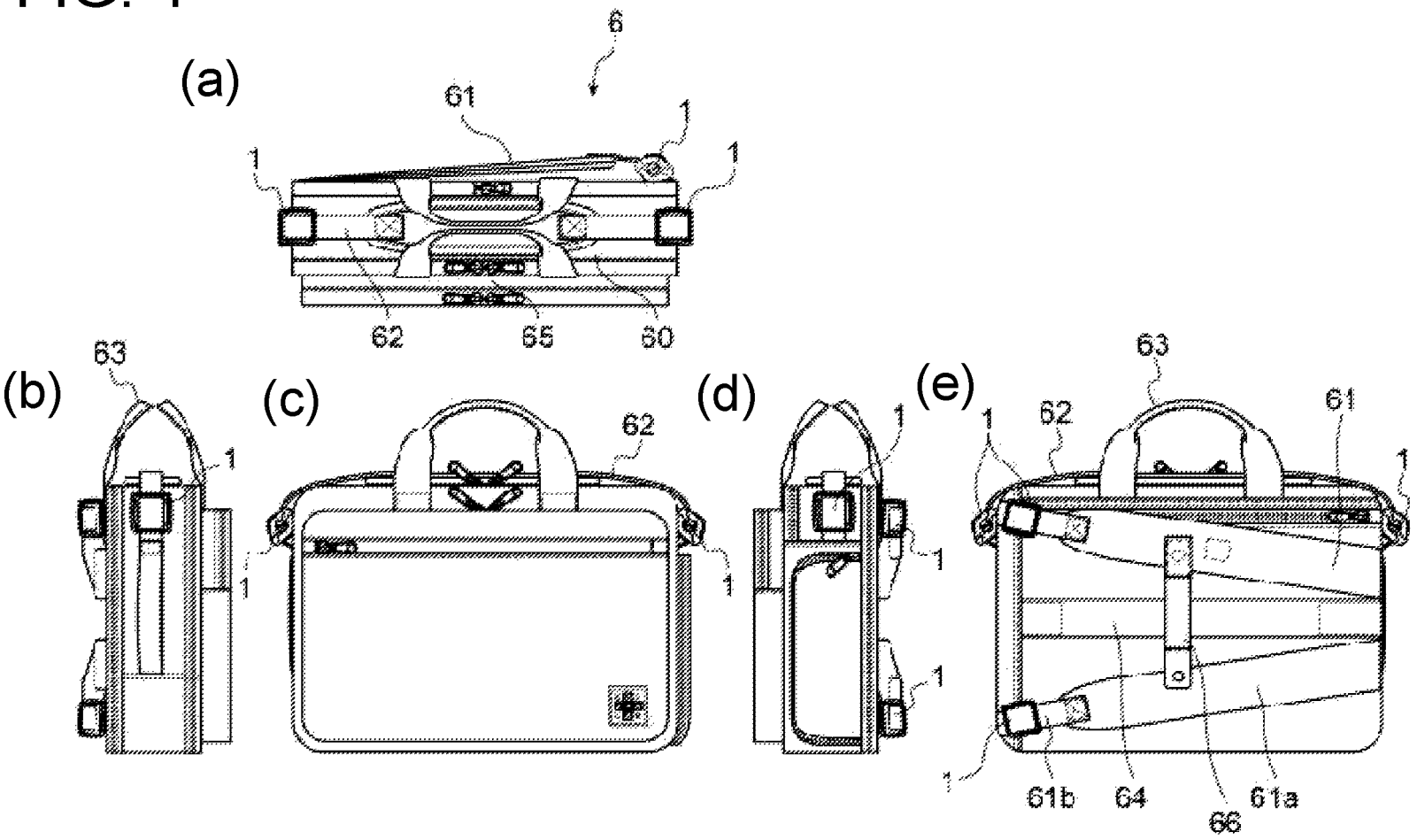
FIG. 4 is the belt retractor of FIG. 3 attached to the bag is shown in (A) plan view, (B) left side view, (C) front view, (D) right side view, and (E) rear view.

The method of attaching such a belt retractor 1 to the strap of a bag will now be described. As shown in FIG. 4, the bag 6 of the embodiment of the invention consists of a main body 60, a backpack strap 61 for carrying the main body as a backpack, a shoulder strap 62 for carrying the main body on the shoulder as a shoulder bag, a pair of grippers 63 for gripping the main body in a hand-held manner, wheel carry straps 64 for attaching the main body to a wheeled carry-on bag, and at least one opening 65 for inserting and removing luggage into and from the main body, which is opened and closed by a zipper.

The backpack strap 61 comprises a shoulder pad 61*a* and a strap belt 61*b* sewn together at one end, each being sewn to the main body 60 at the other end. The belt retractor 1 is attached to the strap belt 61*b* near the center of the strap belt 61*b* in the longitudinal direction. The belt retractor 1 installed as described above winds and stores the strap belt 61*b* so that, as shown in FIG. 4, when the strap belt 61*b* is not carried on the back, the strap belt 61*b* is stored and the backpack straps 61 become an integral part of the main body 60 and can be carried in a hand-held manner using the handles 63. When the bag 6 is carried or used as a shoulder bag using the shoulder strap 62, the backpack strap 61 does not hang down. Also, unlike conventional backpack straps, the length adjusting mechanism is incorporated in the belt retractor 1, so that the excess ends of the backpack straps do not hang down, and when used as a backpack, the backpack straps 61 extend to the length you set. Of course, the length adjustment mechanism of the belt retractor 1 should be set to the same degree on both sides. The backpack strap 6 has a chest strap 66 between the pads 61*a*, one end (lower end in the figure) of which is axially connected to the pad 61*a* by a shaft and the other end of which is also magnetized to the other pad 61*a* by a strong magnet.

The shoulder strap 62 also comprises a shoulder pad 62*a* sewn to one end of each of a pair of strap belts 62*b* in the middle of the longitudinal direction of the shoulder strap 62, and the pair of strap belts 62*b* are each sewn to the main body 60 at the other end thereof.

The belt retractor 1 is attached to each of the pair of strap belts 62*b* near the center of each of the strap belts 62*b* in the longitudinal direction. The belt retractor 1 installed as described above winds and stores the strap belts 62*b* so that, as shown in FIG. 4, when the strap belts 62*b* are not worn on the shoulder, the strap belts 62*b* are stored and the shoulder straps 62 become an integral part of the main body 60 and the handles 63 can be used to carry the bag 6 in a hand-held manner When the bag 6 is carried or used as a backpack using the backpack strap 61, the shoulder strap 62 does not hang down. Moreover, unlike conventional shoulder straps, the length adjusting mechanism is incorporated in the belt retractor 1, so that no adjusting ring or metal bracket is required to make the shoulder strap detachable. In addition, the shoulder pad 62*a* can be sewn to the center of the shoulder strap, which avoids problems that tend to occur with conventional shoulder straps, such as the shoulder pad shifting from the center or turning inside out. When used as a backpack, the 61 backpack straps extend to the set length. Obviously, the length adjustment mechanism of the strap retractor 1 should be set to the same degree on both sides.

The configuration of the webbing retractor 1 will now be described in more detail. As shown in FIG. 1, the belt retractor 1 comprises an outer member 2, a cylinder member 3 and a pin member 4 as core members rotatably provided inside the outer member 2, and a spring 5 as an elastic member forcing the cylinder member 3 and the pin member 4 as core members to rotate against the outer member 2.

The parts other than the spring 5 are made of resin, but may also be made of metal.

The outer member 2 has an open side 21 and a closed side 22 which are a pair of approximately rhombic surfaces provided perpendicularly to the rotation axis of the pin member 4, a pair of pillar parts 23 passed between the ends of these open side 21 and closed side 22 in the form of vertical columns, a pin member 4 provided at the center of the inner side of the closed side 22 and rotatable 24 for bearing, two pairs of slits 26 in the open side 21 and a pair of elastic portions 27 defined lineally symmetrically thereby, and a pair of projections 28 at the tips of these portions, and an opening 29 formed at the center of the open side 21.

The open side 21 is approximately rhombic as described above, and an opening 29 is formed in the center. Since this opening 29 is a hole into which the pin member 4 is inserted and into which its head 41 can rotatably fit, it is circular with an inner diameter slightly larger than the head 41 of the pin member 4.

Part of the arc of this circle is formed by a pair of projections 28.

A pair of elastic portions 27 bridged by two pairs of slits 26 provided in the longitudinal direction of the open side 21 have elasticity derived from the material of the resin, and a projection 28 is provided at the tip thereof. The elastic portion 27 and the projection 28 constitute the pressing portion. The protrusion 28 is a member for pressing the cylinder member 3 toward the closing surface 22, and protrudes toward the closing surface 22. As shown in FIG. 2, the side surface of the projection 28 has a slope surface 28*a*. When the cylinder member 3 is assembled into the outer member 2 from the side, this slope surface 28*a* is pressed by the cylinder member 3 and the protrusion 28 is pushed outward by the elasticity of the elastic portion 27 so that the cylinder member 3 can smoothly enter the outer member 2. Thus, the cylinder member 3 can smoothly enter the outer member 2. Furthermore, the protrusion 28 is provided at the periphery of the opening 29, which has the effect of making the friction surface between the cylinder member 3 and the outer member 2 as radially inward and as small in area as possible, thereby increasing the rotatability of the cylinder member 3. The protrusion 28 urges the cylinder member 3 toward the closed surface 22 when the cylinder member 3 is assembled in the outer member 2. Conversely, when the cylinder member 3 is pressed toward the open face 21, the projection 28 escapes outward. In this case, a pair of blocking block portions 21*a* are provided inside the open side 21 as parts for restricting the movement of the cylinder member 3 toward the open side 21. Since these blocking block portions 21*a* are parts for restricting the movement of the cylinder member 3 toward the open side 21 while ensuring the gap necessary for assembling the cylinder member 3 into the outer member 2, they protrude from the side of the slit 26 on the side opposite to the side where the cylinder member 3 is assembled into the outer member 2. If the material is flexible enough to allow the cylinder member 3 to be assembled into the outer member 2 even if the open side 21 is provided on the inside without the block portion 21*a*, the block portion 21*a* may not be provided.

A pair of pillar portions 23 are provided perpendicularly to the open side 21 and the closed side 22, connecting their respective vertices, with a pair of restricting blocks 23*a* and 23*b*, respectively, inside the connection to each. These restricting blocks 23*a* and 23*b* restrict the belt B to prevent it from approaching the open side 21 or the closed side 22 when it is wound. The column sections may not be limited to one pair, but may be two pairs, etc., depending on the strength of the material, etc.

In the center of the closing surface 22, there is a bearing portion 24 which is a circular convex portion for bearing the pin member 4. A circular bearing concave portion 24*a* is provided in the center of the bearing portion 24 for receiving the tip convexity 42 of the pin member 4, and a slit 24*b* is provided slightly off-center of the bearing portion 24 for receiving the inner end 5*b* of the spring 5. The spring 5 is a spring having an inner end 5*b* bent and formed into an L-shape and an outer end 5*a* bent and formed into a U-shape, and has at least about 4 turns.

The cylinder member 3 has a pair of circular surfaces, first surface 31 and second surface 32, corresponding to the open side 21 and closed side 22 described above, which are supported on each other by four cylinder members 33 as belt winders perpendicular to the surfaces. The first and second faces 31 and 32 have first and second holes 35 and 34, respectively, drilled in their centers to receive the shaft 43 of the pin member 4, the inner diameters of which are slightly larger than the outer diameter of the shaft 43 of the pin member 4. The second hole 34 is surrounded by a cross-shaped hole toward the column member 33, but this is a device for removing the mold, and functionally the second hole 34 may be a circular hole.

The outer surface of the second surface 32 is provided with a spring receiving convex portion 32*a* projecting vertically from the second surface 32 at a portion near the periphery. This is a projection for receiving the outer end 5*a* of the spring 5. As a result, the cylinder member 3 is forced to rotate against the outer member 2 by the spring 5. An arc-shaped projection 32*b* is provided around the second hole 34 on the outer surface of the second surface 32 to prevent the spring 5 from touching the second surface 32 as much as possible and to adjust the gap between the cylinder member 3 and the outer member 2. A circumferential flange 32*c* is provided perpendicular to the second face 32 on the circumference of the second face 32 to prevent the user from accidentally touching the spring 5.

The pin member 4 has a brim-shaped head 41 at one end, a tip convexity 42 at the other end, and a shaft 43 extending therebetween.

The head 41 has a groove 41*a* at the center into which a flat head screwdriver or coin can be inserted. The shaft portion 43 has a slit 43*a* along its longitudinal direction as an insertion portion for inserting the strap B. The shaft portion 43 also has a pair of engaging convex portions 43*b* projecting perpendicularly in the axial direction from near the head 41, passing through the cutout 36 and engaging the engaging concave portions 37.

To assemble such a belt retractor 1, the spring 5 is set in the outer member 2 with the inner end 5*b* inserted in the slit 24*b*, and the cylinder member 3 is set in the outer member 2 with the outer end 5*a* hooked on the spring receiving convex 32*a*. In this process, the second side 32 is first placed against the closed side 22 so that the second hole 34 corresponds to the bearing portion 24, then the slope surface 28*a* of the projection 28 is pressed with the circumference of the first side 31, and the projection 28 is pushed outward by the elasticity of the elastic portion 27 so that the first side 31 is parallel to the open side 21. Then, the pin member 4 is inserted into the opening 29 and the first hole 35, and the tip convex portion 42 is inserted into the bearing concave portion 24*a*. At this time, align the pin member 4 so that the engagement convex portion 43*b* passes through the notch 36. Then, the cylinder member 3 is moved toward the open side 21 while the projection 28 is pushed outward by the elasticity of the elastic member 27. Then, the engaging convex portion 43*b* passes through the notch 36, and a coin or the like can be engaged in the groove 41*a* to rotate the pin member 4 on its axis. When the pressure on the projection 28 is released at the position where the engagement convex portion 43*b* corresponds to the engagement concave portion 24*a*, the cylinder member 3 moves toward the closing surface 22 and the engagement convex portion 43*b* engages the engagement concave portion 24*a*, thereby integrating the pin member 4 and the cylinder member 3. In this way, the assembly is completed as shown in FIGS. 4(*a*), 4(*b*) and 4(*d*). As can be seen here, the elastic member 27 has the function of both releasing the projection 28 outwardly when the cylinder member 3 is integrated into the outer member 2 and releasing the projection 28 outwardly to disengage the engagement concave portion 43*b* and the engagement concave portion 24*a*.

In this state, the core member in which the pin member 4 and the cylinder member 3 are incorporated is rotated several times in the direction indicated by the arrow D in FIG. 4(*c*) against the force of the spring 5. Then, while maintaining the same state, the strap is placed in the position indicated by the double-dashed line B in FIG. 4(*c*), i.e., entering from one side of the pillar portion 23, passing between the pillar portion 23 and the pillar member 33, passing from the other side of the slit 26 to one side, passing between the pillar member 33 on the opposite side and the pillar portion 23 on the opposite side, and exiting to the other side, taking an S-shaped path. through the strap retractor 1 so that it passes through the strap retractor 1. When the core member is released from its retainer, the spring 5 is forced to wind the core member in the opposite direction of arrow D in FIG. 4(*c*), and the strap is caught by the slit 26 and wound around the core member, i.e., around the pillar member 33 of the cylinder member 3, and stored in space S1. The strap is then sewn to the bag. This prevents the strap retractor 1 from coming off the strap.

The method of adjusting the extended length of the strap belt is described below. With the strap belt extended by the weight of the bag as described above, the cylinder member 3 is moved toward the open side 21 while the projection 28 is pushed outward by the elasticity of the elastic member 27. Then, the engagement between the engaging convex portion 43*b* and the engaging concave portion 24*a* is released, and the pin member 4 can be rotated axially by engaging a coin or the like in the groove 41*a*. When the pin member 4 is axially rotated, the strap belt is wound around the pin member 4, i.e., stored in the space S2 between the pillar member 33 and the pin member 4. When the strap belt has a suitable length, the engagement concave portion 24*a* is aligned with the engagement convex portion 43*b*, and when the pressure of the projection 28 is released by the cylinder member 3, the engagement convex portion 43*b* is engaged with the engagement concave portion 24*a*, the pin member 4 and the cylinder member 3 are integrated, and the strap belt stored in the space S2 is not extended. The strap belt stored in the space S2 is not extended. In this way, the extended length of the strap belt can be adjusted as desired. The adjustment of the extended length is made in one step for each half turn of the pin member 4 and is not a stepless adjustment, i.e. if the number of turns of the pin member 4 in the left and right belt retractors 1 is the same, the extended length of the strap belt can be made exactly the same on both sides. The length of the strap belt can be adjusted equally on the left and right sides very easily and accurately compared to the conventional adjustment.

As described above, the belt retractor 1 of the first embodiment can realize a bag 6 in which the strap belt is automatically wound up so that the strap belt does not get in the way, the extended length of the strap belt can be adjusted, and no obstructive ends of the strap belt appear. Here, the belt retractor 1 of the first embodiment is an example, and various changes can be made in a method that achieves the same effect. For example, the number and shape of the column members of the outer member and the cylinder member, the shape and position of the pressing portion can be changed as needed, and the engagement relationship between the pin member and the cylinder member and the pin member can be reversed. In addition to the spring, elastic members such as string springs and rubber can be used. Both ends of the spring can be engaged with the outer member and the pin member. Furthermore, when the core member is composed of a single member, at least the strap belt can be automatically wound up to realize a bag in which the strap belt does not get in the way, even if a separate mechanism is required in terms of extended length adjustment. In addition to bags, belt retractors can also be used for straps for musical instruments, seat belts, hip belts, packing straps, cables and cords, etc.

Figure 5:
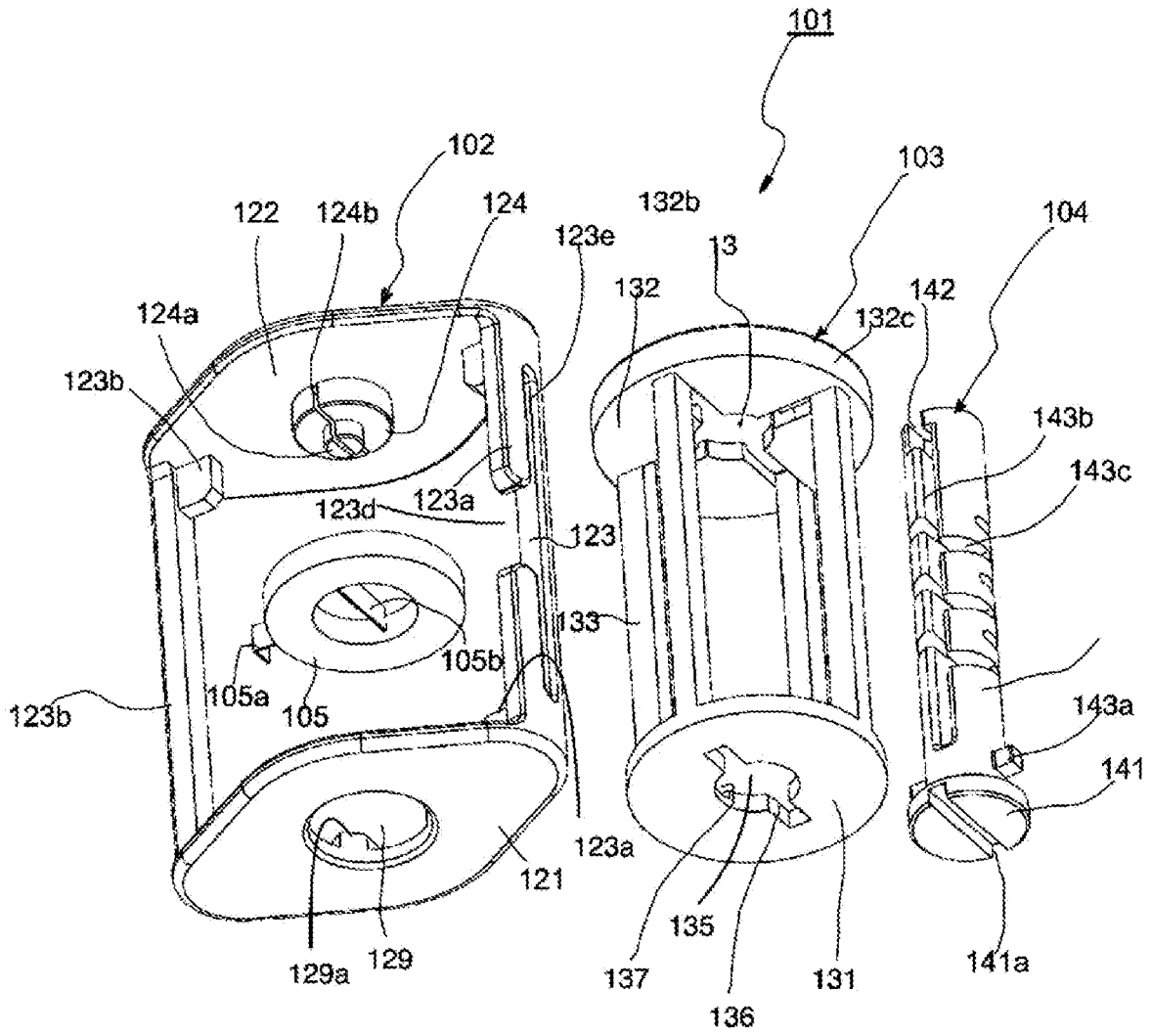
FIG. 5 is an exploded view of the belt retractor of the second embodiment.
Figure 6:
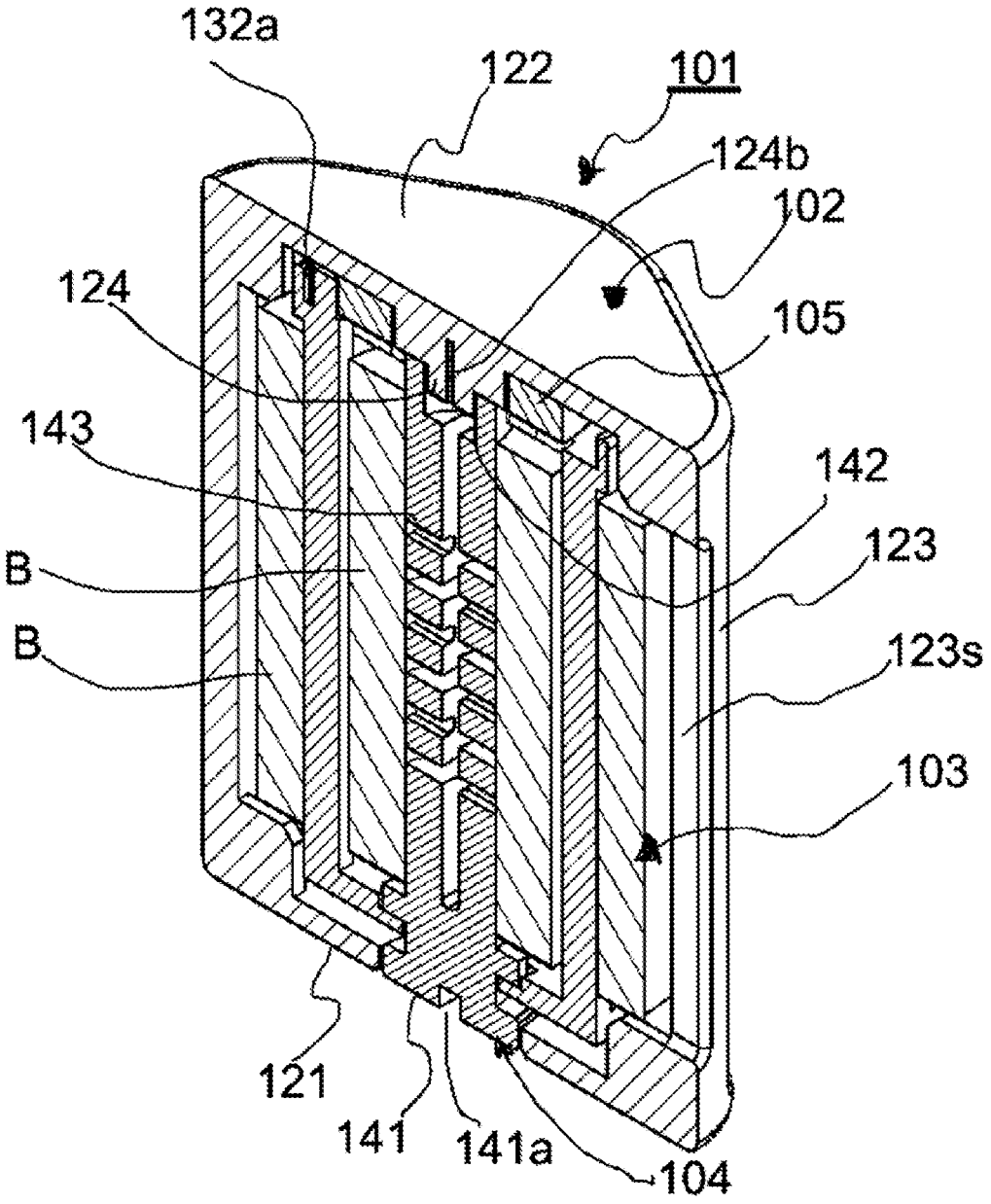
FIG. 6 is a cross-sectional view of the assembled belt retractor of FIG. 5.

The belt retractor 101 of the second embodiment is then described using FIGS. 5 and 6. The belt retractor 101 is similar to the belt retractor 1 of the first embodiment in many respects, but differs significantly in that the elastic structure is provided in the pin member instead of the outer member, and in that the pin member has a slot in the column of the outer member which allows it to be retrofitted to the strap belt. The pin member may be retrofitted to the strap.

The belt retractor 101 of the second embodiment comprises an outer member 102, a cylinder member 103 and a pin member 104 as core members rotatably provided inside the outer member 102, and a spring 105 as an elastic member forced to rotate the cylinder member 103 and the pin member 104 as the core members against the outer member 102. The parts other than the spring 105 are made of resin, but may also be made of metal.

The outer member 102 has an open side 121 and a closed side 122, which are a pair of approximately rhombic surfaces provided perpendicularly to the rotational axis of the pin member 104, and a pair of columnar portions 123 passed between the ends of these open side 121 and closed side 122 in the form of vertical columns, a bearing portion 124 for rotatably bearing the pin member 104 provided at the center of the inner surface of the closed surface 122, and a plurality of projections 129*a* provided at the periphery of the opening 129 on the inner surface of the open side 121.

The open side 121 is approximately rhombic as described above, and an opening 129 is formed in the center.

This opening 129 is a hole into which the pin member 104 is inserted and into which the head 141 thereof is rotatably fitted, such that it is circular with an inner diameter slightly larger than the head 141 of the pin member 104. The projection 129*a* protrudes toward the closed side 122 to limit the movement of the cylinder member 103 toward the open side 121 and to reduce the friction between the cylinder member 103 and the outer member 102 to increase the rotatability, and to provide a gap to facilitate the insertion of the cylinder member 103 into the outer member 102. If the side surface of the protrusion 129*a* is slope, the cylinder member 103 can enter the outer member 102 more smoothly. If the material is flexible enough to allow the cylinder member 3 to be assembled into the outer member 2 even if the open side 21 is provided inside without the projection 129*a*, and if the coefficient of friction between the cylinder member 103 and the outer member 102 is sufficiently small, the projection 129*a* may not be provided.

The pair of columns 123 are provided perpendicularly to the open side 121 and the closed side 122, connecting their respective apexes, with a pair of restricting blocks 123*a* and 123*b*, respectively, inside the connection to each. These restricting blocks 123*a* and 123*b* restrict the belt B to prevent it from approaching the open side 121 or the closed side 122 when it is wound. Here, parallel to one (right side in the figure) of the column sections 123, there is an auxiliary column section 123*c*. This auxiliary pillar 123*c* is provided vertically from the open side 121 and the closed side 122, parallel to the pillar 123, but there is a gap 123*d* in the middle of its longitudinal direction so that the auxiliary pillar 123*c* extending from the open side 121 and the auxiliary pillar 123*c* extending from the closed side 122 are not connected. Therefore, a slit 123*e* is formed between the pillar portion 123 and the auxiliary pillar portion 123*c*. When the strap belt is positioned in the slit 123*e* through the gap 123*d*, the strap belt slides through the slit 123*e* and does not come off, making it possible to retrofit the belt retractor 101 to the strap belt sewn on the bag. The columns may not be limited to one pair, but may be two pairs, etc., depending on the strength of the material, etc.

In the center of the closed surface 122 is a bearing portion 124, which is a circular convex portion for bearing the pin member 104. A circular bearing convex portion 124*a* is provided in the center of the bearing portion 124 to be inserted into the tip cylinder member 142 of the pin member 104, and a slit 124*b* is provided through the center of the bearing portion 124 to receive the inner end 105*b* of the spring 105. The spring 105 is a spring having an inner end 105*b* bent and formed into an L-shape and an outer end 105*a* bent and formed into a U-shape, and has at least about 4 turns.

Cylinder member 103 is constructed in much the same manner as cylinder member 3. The cylinder member 103 has a pair of circular surfaces, first surface 131 and second surface 132, corresponding to the open side 121 and closed side 122 described above, supported by four vertical column members 133. The first and second faces 131 and 132 have first and second holes 135 and 134, respectively, drilled in their centers to receive the shaft portion 143 of the pin member 104, the inner diameters of which are slightly larger than the outer shape of the shaft portion 143 of the pin member 104. The second hole 134 is surrounded by a cross-shaped hole toward the column member 133, but this is a mold removal device, and the second hole 134 may be a circular hole for functional purposes.

On the first side 131, a cutout 136 for the engagement convex portion 143*a* of the pin member 104 to pass through is perforated through the front and back sides in succession to the first hole 135. In addition, an engagement concave portion 137 for the engagement concave portion 143*a* of the pin member 104 is provided on the inside of the first surface 131 at a position adjacent to the first hole 135. This engagement concave portion 137 is deep enough to reach from the inner surface of the first face 131 to about half of its thickness.

As with the cylinder member 3, some of the figures are omitted, but the outer surface of the second surface 132 is provided with a spring receiving convexity that projects vertically from the second surface 132 at a portion near the periphery. This is a projection for receiving the outer end 105*a* of the spring 105. As a result, the cylinder member 103 is forced to rotate with respect to the outer member 102 by the spring 105. An arcuate projection 132*b* is provided around the second hole 134 on the outer surface of the second surface 132, and serves to adjust the gap between the cylinder member 103 and the outer member 102. A circumferential flange 132*c* is provided perpendicularly to the second surface 132 on the outer periphery of the second surface 132 to prevent the user from accidentally touching the spring 105.

The pin member 104 has a flanged head 141 at one end, a tip cylinder member 142 at the other end, and a shaft portion 143 extending therebetween. The head 141 has a groove 141*a* in the center into which a flat head screwdriver or coin can engage. The shaft portion 143 has a slit 143*b* along its longitudinal direction as an insertion portion for inserting the tape B. The shaft portion 143 has a pair of engaging convex portions 143*a* projecting perpendicularly in the axial direction from near the head 141, passing through the slit 136, and engaging the engaging concave portions 37. In particular, the pin member 104 differs from the pin member 4 in that the tip cylinder member 142 is divided into two halves and the shaft portion 143 has a plurality of cutouts 143*c* provided perpendicularly to the axis. First, the tip cylinder member 142 is divided into two halves so that the slit 143*b* penetrates to the tip of the pin member 104, allowing a belt to be inserted from the tip side so that the belt retractor 101 can be retrofitted to a strap belt sewn on the bag. The plurality of cutouts 143*c* allows the shaft portion 143 to contract in an elastic axial direction. This allows the engagement convex portion 143*a* to engage and disengage with the engagement concave portion 137 without moving the cylinder member 103 in the axial direction.

To assemble such a belt retractor 101, the spring 105 is placed in the outer member 102 with the inner end 15*b* inserted in the slot 124*b*, and the cylinder member 103 is placed in the outer member 2 with the outer end 105*a* hooked to the spring receiving convex. In this process, first the second face 132 is placed against the closed face 122 so that the second hole 134 corresponds to the bearing 124, and then the periphery of the first face 131 is pressed against the slope surface of the projection 129*a* to elastically deform the outer member 102 while pushing the first face 131 parallel to the open face 121.

At this point, it is possible to retrofit the belt in the belt retractor 101 to the belt sewn to the bag. When retrofitting, at this point, the cylinder member 103 is rotated axially several times against the force of the spring 105. While maintaining this state, the belt retractor 101 is applied from the side of the strap belt, and the strap belt is placed in the slit 123*e* using the gap 123*d*. Further, the middle portion of the strap belt is placed between the two adjacent cylinder members 133 of the cylinder member 103, then the pin member 104 is inserted into the opening 129 and the first hole 135, and the strap belt is placed between the two halves of the tip cylinder member 142 with the strap belt positioned in the slit 143*b*. With the strap positioned in the slot 143*b*, the bearing convex 124*a* is inserted into the tip cylindrical portion 142 and the pin member 104 is aligned so that the engagement convex 143*b* passes through the notch 136. The head 141 is then pushed axially to compress the shaft portion 143 by elastic deformation. The engagement convex 143*b* then passes through the notch 136 and is disengaged so that a coin or the like can be engaged in the groove 141*a* and the pin member 4 can be rotated axially. When the pressure on the head 141 is released at the position where the engaging convex portion 143*b* corresponds to the engaging concave portion 124*a*, the pin member 104 is released from compression and the engaging convex portion 143*b* engages the engaging concave portion 124*a*, thereby integrating the pin member 4 and the cylinder member 3. In this way, the assembly of the belt retractor 101 to the strap belt is completed even if the strap belt has been sewn to the bag in advance. This retrofitting to the strap belt is possible because the tip cylindrical portion 142 is bi-directional. The presence of the auxiliary pillar 123*c* also prevents the belt retractor 101 from hanging down on the strap belt, and allows the belt retractor 101 to be assembled along the strap belt.

When the cylinder member 103 and the pin member 104 are released from holding the core member integrated with the cylinder member and the pin member 104 in the state described above, the core member is wound by the force of the spring 105, and the strap belt is gripped by the slit 127 and wound around the core member, namely around the pillar member 133 of the cylinder member 103, and stored in the space S11. In this manner, the strap is wound around the core.

When the bag is carried with the belt retractor 101 set on the shoulder strap or backpack strap in this manner, the self-weight of the bag forces the strap belt to release its storage against the force of the spring 105, and the strap belt is extended.

Here, if the strap belt is felt to be too long, the length by which the strap belt is extended can be limited by adjusting the strap retractor 101.

The method of adjusting the extended length of the strap belt is described below. When the strap belt is extended by the weight of the bag as described above, the head 141 is pushed in axially to compress the shaft portion 143 by elastic deformation. Then, the engagement convex portion 143*b* passes through the notch 136 and is disengaged so that a coin or the like can be engaged in the groove 141*a* and the pin member 4 can be rotated axially. Then, the engagement between the engaging convex portion 143*b* and the engaging concave portion 124*a* is disengaged, and the pin member 104 can be rotated axially by engaging a coin or the like in the groove 141*a*. When the pin member 104 is rotated axially, the strap belt is wound around the pin member 104, i.e., stored in the space S102 between the pillar member 133 and the pin member 104. When the strap belt reaches a suitable length, the engagement concave portion 124*a* is aligned with the engagement convex portion 143*b* and the pressure of the head 141 is released, the engagement convex portion 143*b* engages with the engagement concave portion 124*a*, the pin member 104 and the cylinder member 103 are integrated, and the strap belt stored in the space S102 is not extended. The strap belt stored in the space S102 is not extended. In this way, the extended length of the strap belt can be adjusted as desired. Since the adjustment of the extended length is made in one step for each half turn of the pin member 104 and is not a stepless adjustment, the extended length of the strap belt can be made exactly the same on both sides by making the same number of turns of the pin member 104 in the belt retractors 101 on the left and right sides, which is very easy and accurate compared to conventional adjusting buckles.

As described above, the belt retractor 101 of the second embodiment can realize a bag in which the strap belt is automatically wound up so that the strap belt does not get in the way, the extended length of the strap belt can be adjusted, and the end of the strap belt does not get in the way. The belt retractor 101 of the second embodiment is an example and can be modified in various ways to achieve the same effect. For example, the material is not limited to resin, but can also be metal or wood, and can be combined with other materials for the elastic portion. The number and shape of the columns of the outer member and the cylinder member, as well as the shape and position of the pressure portion, can be changed as needed, and the engagement relationship between the cylinder member and the pin member and the cylinder member can be reversed. In addition to the spring, elastic members such as string springs and rubber can be used. Both ends of the spring can be engaged with the outer member and the pin member. Furthermore, if the core member is composed of a single member, at least the strap belt can be automatically wound up to realize a bag in which the strap belt does not get in the way, even if a separate mechanism is required with respect to the extended length adjustment.

Figure 7:
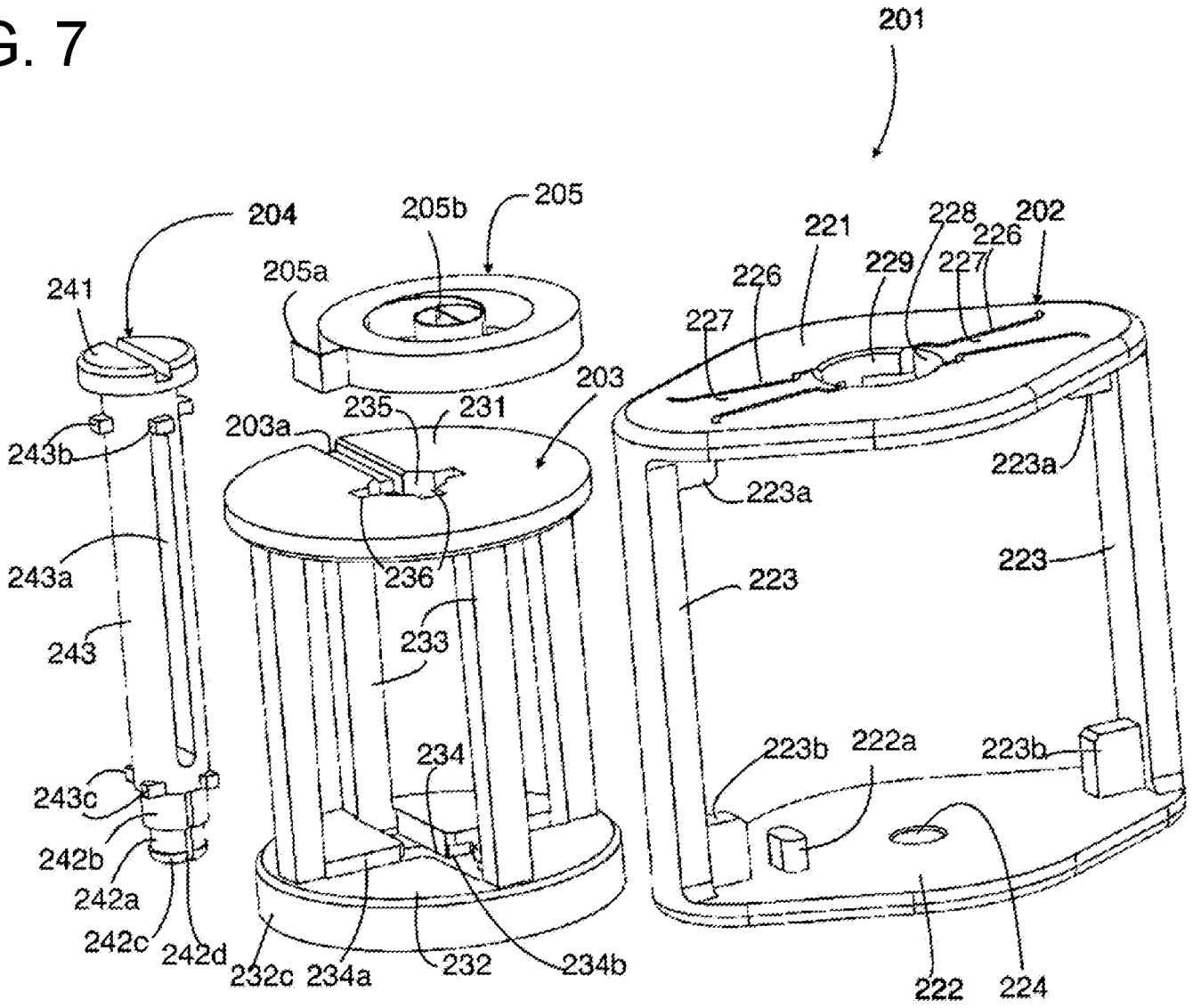
FIG. 7 is an exploded view of the third type of retractor.
Figure 8:
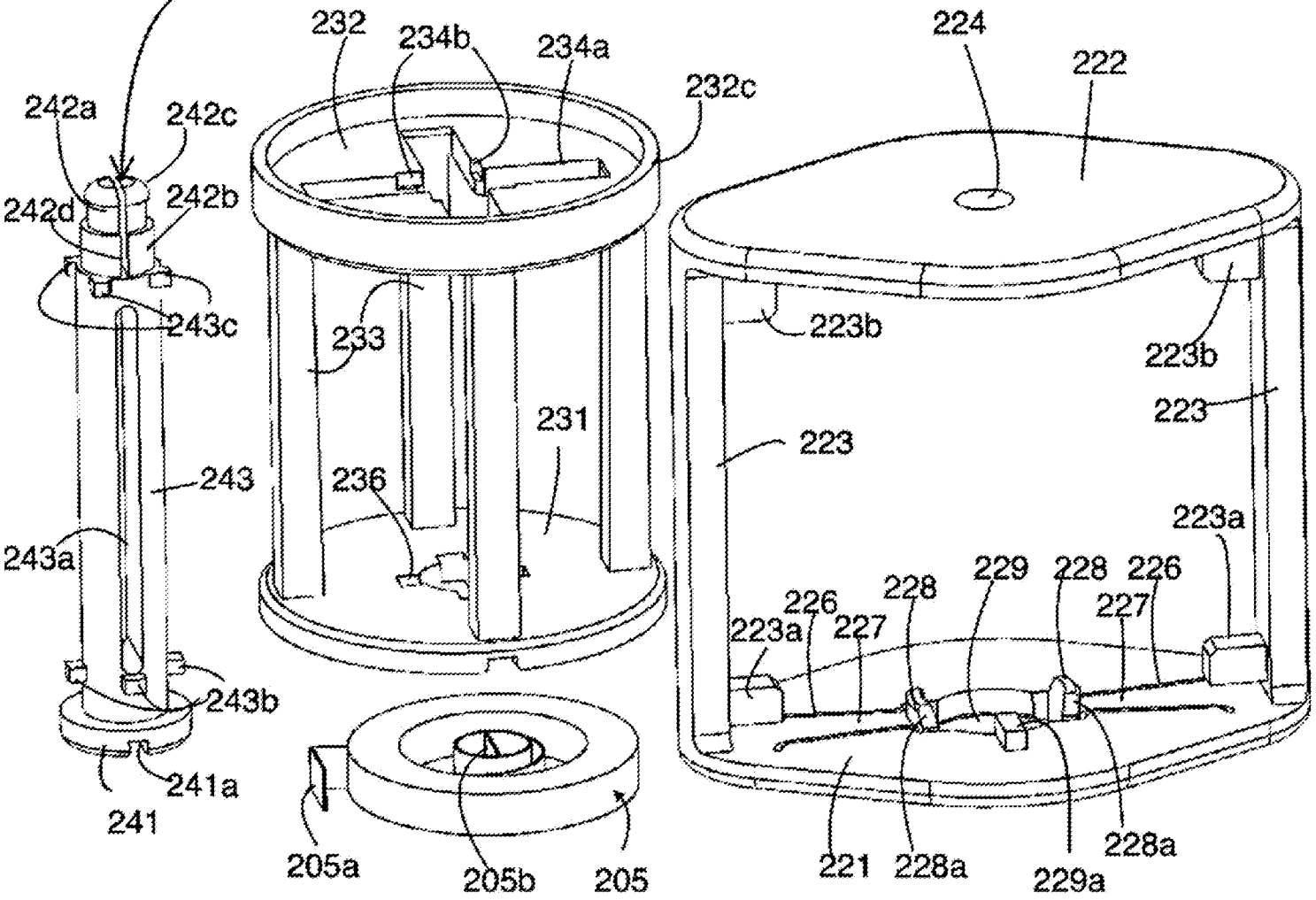
FIG. 8 is an exploded view of the belt retractor of FIG. 5 from another angle.

The belt retractor 201 of the third embodiment is then described by reference to FIGS. 7 and 8. The belt retractor 201 is similar in many respects to the belt retractor 1 of the first embodiment, but differs significantly primarily in that the pin member penetrates the outer member and has a detent, the inner end of the spring engages the pin member and the outer end engages the outer member, and when the cylinder member is moved against the force of the outer member, it engages the outer member.

The third embodiment of the belt retractor 201 comprises an outer member 202, a cylinder member 203 and a pin member 204 as a core member rotatably provided inside the outer member 202, and a spring 205 as an elastic member forced to rotate the cylinder member 203 and the pin member 204 as the core member against the outer member 202. The spring 205 is provided as the core member. The parts other than the spring 205 are made of resin, but may be made of metal.

The outer member 202 has an open side 221 and a bearing surface 222, which are a pair of approximately rhombic surfaces provided perpendicular to the rotational axis of the pin member 204, and a pair of columnar portions 223 passed between the ends of these open side 221 and bearing surface 222 in a vertical columnar form, wherein a bearing hole 224 for rotatably bearing the pin member 204 is provided at the center of the inner surface of the bearing surface 222, and an engaging projection 229*a* is provided at the periphery of the opening 229 on the inner side of the open side 221.

The open face 221 is approximately rhombic as described above and has an opening 229 in the center. This opening 229 is a hole into which the pin member 204 is inserted and into which its head 241 is rotatably fitted, such that it is circular with an inner diameter slightly larger than the head 241 of the pin member 204. Part of the arc of this circle is formed by a pair of projections 228. A pair of elastic portions 227 bridged by two pairs of slits 226 provided in the longitudinal direction of the open side 221 have elasticity derived from the resin material, and the projections 228 are provided at their tips. The elastic portions 227 and the projections 228 form a pressing portion. The protrusion 228 is a member for pressing the cylinder member 203 toward the bearing surface 222, and protrudes toward the bearing surface 222. As shown in FIG. 8, the side surface of the projection 228 has a slope surface 228*a*. When the cylinder member 203 is assembled into the outer member 202 from the side, the slope surface 228*a* is pressed by the cylinder member 203 and the projection 228 is pushed outward by the elasticity of the elastic portion 227. 202 smoothly into the outer member 202. Furthermore, the projection 228 is provided at the periphery of the opening 229, which has the effect of making the friction surface between the cylinder member 203 and the outer member 202 as radially inward and as small in area as possible and increasing the rotatability of the cylinder member 203. The projection 229*a* is a member for engaging with the groove 203*a* provided on the first side 231 of the cylinder member 203 when the cylinder member 203 moves toward the open side 221 to make the cylinder member 203 non-rotatable with respect to the outer member 202, and projects toward the bearing surface 222.

The pair of columns 223 are provided perpendicularly to the open side 221 and the bearing surface 222, connecting their respective peaks, with a pair of restricting blocks 223*a* and 223*b*, respectively, within the connection to each. These restricting blocks 223*a* and 223*b* restrict the belt B to prevent it from approaching the open side 221 or the bearing surface 222 when it is wound. The column sections are not limited to one pair, but may be two pairs, etc., depending on the strength of the material, etc.

At the center of the bearing surface 222 is a bearing hole 224, which is a circular through-hole for bearing the pin member 204. The bearing hole 224 is a circular through-bearing hole for insertion of the tip 242 of the pin member 204. A block 222*a* is provided near the periphery of the bearing surface 222 for engaging the outer end 205*a* of the spring 205. The spring 205 is a spring having an inner end 205*b* bent and formed into an L-shape and an outer end 205*a* bent and formed into a U-shape, and has at least about four turns.

The cylinder member 203 has a pair of circular surfaces, first surface 231 and second surface 232, corresponding to the open side 221 and bearing surface 222 described above, which are supported by four vertical column members 233. The first and second faces 231 and 232 have first and second holes 235 and 234, respectively, drilled in their centers to receive the shaft 243 of the pin member 204, and their inner diameters are slightly larger than the outer shape of the shaft 243 of the pin member 204. Around the second hole 234, a hole 234*a* is provided in a cross shape toward the column member 233, which is both a device for removing the mold and for passing through the tip-side engaging convex portion 243*c* of the pin member 204, as described below.

Following the first hole 235, the first side 231 is perforated with four cutouts 236 through the front and back sides for the four head-side engagement convex portions 243*b* and the four tip-side engagement convex portions 243*c* of the pin member 204 to pass through. The cut-outes 236 also serve as engagement concave portions for the head-side engagement convex portions 243*b*.

Four engagement concave portions 234*b* are provided on the outside of the second surface 232 in succession to the holes 234*a*.

These are for engagement with the tip-side engagement convex portions 243*c* of the pin member 204. A circumferential flange 232*c* is provided on the circumference of the second surface 232 perpendicular to the second surface 232 to prevent the user from accidentally touching the spring 205.

The pin member 204 has a brim-shaped head 241 provided at one end, a shaft portion 243 connected thereto, a tip portion 242*a* provided at the other end, a spring engaging portion 242*b* connected to the head side thereof, and a retaining clip 242*c* provided at the tip of the tip portion 242*a*. The pin member 204 has a slit 242*d* passing through the axis from the tip to the spring engaging portion 242*b* via the tip 242*a*. This slit 242*d* is for receiving the inner end 205*b* of the spring 205. The head 241 has a groove 241*a* in the center which can be engaged by a flat head screwdriver or a coin. In this third embodiment, this groove 241*a* can function without. The shaft 243 has a slit 243*b* along its longitudinal direction as an insertion portion for inserting the belt B. This slit 243*b* is not limited to a straight line, but can be made wavy or the like, in which case it is easier to fix it in any position in the belt B. The shaft 243 also has four head-side engagement convexities 243*b* that project perpendicularly in the axial direction from near the head 241, pass through the cutout 236, and possibly engage said cutout 236. In addition, the shaft portion 243 has four tip-side engaging convex portions 243*c* that project perpendicularly in the axial direction from a position adjacent to the spring engaging portion 242*b*, pass through the cutout 236 and the cross-shaped hole 234*a*, and possibly engage the engaging concave portion 234*b* connected to this cross-shaped hole 234*a*. The spring engaging portion 242*b* is formed thinner than the body of the shaft 243 and is where the spring 205 is wound. The tip 242*a* is even thinner and has an inner diameter slightly smaller than the inner diameter of the bearing hole 224, since it is the part that is inserted into the bearing hole 224. The retaining clip 242*c* at the end thereof is formed thicker than the inner diameter of the bearing hole 224 in a caeci-like shape and passes through the bearing hole 224 using the flexibility created by the slit 242*d*, so that the pin member 204 cannot come out of the bearing hole 224 after the elastic deformation is restored.

To assemble the belt retractor 201, a jig (not shown) is inserted into the bearing hole 224 from outside the bearing hole 224 to hold the inner end 205*b* of the spring 205. In addition, when the spring 205 is wound, the outer end 205*a* is engaged with the block 222*a*. The jig should be a mechanism held by the bearing surface 222. The cylinder member 203 is then fitted into the outer member 202 from the side. First, the second side 232 is placed against the bearing surface 222 so that the second hole 234 corresponds to the bearing hole 224, and then the circumference of the first side 231 pushes the slope surface 228*a* of the projection 228, and then the first side 231 is pushed parallel to the open side 221 while pushing the projection 228 outward using the elasticity of the elastic portion 227. Push it in so that the first face 231 becomes parallel to the open face 221. At this time, install the groove 203*a* in a position corresponding to the engagement projection 229*a*. Then, the pin member 204 is inserted into the opening 229 and the first hole 235, and the tip 242*a* is inserted into the bearing hole 224, and the spring engaging portion and the tip engaging convex portion 243*c* are inserted into the second hole 234. Then, the retaining clip 242*c* is passed through the bearing hole 224 and is restored to function as a retaining clip. In this state, the jig is disengaged and the spring 205 attempts to rotate the pin member 204 by the restoring force. In this case, when the pressure on the projection 228 is released at the position where the head-side engagement concave portion 243*b* corresponds to the notch 236 or the tip-side engagement concave portion 243*c* corresponds to the engagement concave portion 234*b*, the cylinder member 203 moves toward the bearing surface 222, the head-side engagement concave portion 243*b* engages the notch 236, the tip-side engagement concave portion 243*c* engages the engagement concave portion 234*b*, thereby integrating the cylinder member and the pin member 204 with the cylinder member 203. Furthermore, when a piece of cardboard or the like not shown in the figure is placed between the circumferential flange 232*c* of the second surface 232 and the bearing surface 222, and the groove 203*a* engages the projection 229*a*, the cylinder member 203 and the outer member 202 are united. When the thickness of the cardboard is adjusted and the cylinder member 203 is integrated with both the outer member 202 and the pin member 204, the spring 205 cannot rotate the pin member 204 due to the restoring force. As can be seen here, the elastic portion 227 has two functions of releasing the projection 228 outward when the cylinder member 203 is integrated with the outer member 202, and moving the cylinder member 203 toward the bearing surface 222 to engage the tip-side engagement concave portion 243*c* and the head-side engagement convex portion 243*b* with the engagement concave portion 234*b* and the cut-out 236.

In this state, the strap is passed through the strap retractor 201 so that it enters from one side of the column portion 223, passes between the column portion 223 and the column member 233, exits from one side of the slot 226 to the other side, and passes between the column member 233 and the column portion 223 on the opposite side to the other side. In this state, when the cardboard is pulled out, the cylinder member 203 moves toward the bearing surface 222 under pressure from the projection 228, the engagement between the projection 229*a* and the groove 203*a* is disengaged, the core member in which the pin member 204 and the cylinder member 203 are integrated is wound by the force of the engagement spring 5, the strap belt is caught by the slit 226, the strap belt is caught by the slit 226 and wound around the core member, i.e., the column member 233 of the cylinder member 203, and stored in the outer member 202. The strap is then sewn to the pouch. This ensures that the strap retractor 201 does not become detached from the strap.

When the bag is carried with the strap retractor 201 attached to the shoulder strap or backpack strap in this manner, the weight of the bag forces the strap belt to release its storage against the force of the spring 205, and the strap belt is extended. Here, if the strap belt is felt to be too long, the length by which the strap belt is extended can be limited by adjusting the belt retractor 201.

The method of adjusting the extended length of the strap belt is described below. With the strap belt extended by the weight of the bag as described above, align the projection 229*a* with the groove 203*a* and move the cylinder member 203 toward the open side 221 while pushing the projection 228 outward using the elasticity of the elastic portion 227. Then, the engagement of the head-side engagement convex portion 243*b* with the cut-out 236 and the engagement of the tip-side engagement convex portion 243*c* with the engagement concave portion 234*b* are released. At the same time, the protrusion 229*a* and the groove 203*a* are engaged. When the bag is lifted and the strap belt is released while the cylinder member 203 is engaged with the outer member 202 and not engaged with the pin member 204, the pin member 204 is axially rotated by the restoring force of the spring 205 and the strap belt is wound around the pin member 204, that is, the strap belt is stored in the space between the column member 233 and the pin member 204. When the strap belt has a suitable length, the head-side engagement concave portion 243*b* and the notch 236 are aligned, and when the pressure of the projection 228 is released by the cylinder member 203, the head-side engagement concave portion 243*b* and the notch 236 are engaged and the tip-side engagement concave portion 243*c* is engaged with the engagement concave portion 234*b*, and the pin member 204 and the cylinder member 203 become one piece, and the strap belt stored in the space between the pillar member 233 and the pin member 204 and not extended any more. In this way, the extended length of the strap belt can be adjusted as desired. In this case, the engagement between the projections 229*a* and the grooves 203*a* is disengaged so that the excess strap is automatically wound around the column member 233. Since the extended length adjustment is made in one step for each quarter turn of the pin member 204 and is not a stepless adjustment, if the number of turns of the pin member 204 in the left and right belt retractors 201 is the same, the extended length of the strap belt can be made exactly the same on both sides, which is very easy and accurate compared to the conventional adjusting backle.

As described above, the third embodiment of the belt retractor 201 can realize a bag in which the strap belt is not disturbed by automatically winding up the strap belt, the extended length of the strap belt can be adjusted, and the disturbing end of the strap belt does not come out. Here, the belt retractor 201 of the third embodiment is an example, and various changes can be made in a method that achieves the same effect. For example, the number and shape of the column members of the outer member and the cylinder member, the shape and position of the pressing portion can be changed as needed, and the engagement relationship between the pin member and the cylinder member and the pin member can also be reversed. In addition to the spring, elastic members such as string springs and rubber can be used. Both ends of the spring can be engaged with the outer member and the pin member. Furthermore, when the core member is composed of a single member, at least the strap belt can be automatically wound up to realize a bag in which the strap belt does not get in the way, even if a separate mechanism is required with respect to the extended length adjustment.

The third embodiment of the strap retractor 201 is advantageous over other embodiments in that the extended length adjustment of the strap belt can be performed by the return force of the spring 205, rather than by manual winding. Thus, the groove 241*a* in the head 241 can be eliminated and the head 241 can be made smaller. Furthermore, by providing the engagement convexities on the head side and the tip side of the pin member 204 and having four convexities on each side, the twisting of the pin member 204 can be suppressed and the engagement between the pin member 204 and the cylinder member and the pin member 203 can be prevented from being unintentionally disengaged. The extended length can be adjusted in one step for each quarter turn of the pin member 204, thereby preventing unintentional disengagement of the pin member. The cylinder member 203 engages with the pin member 204 and the outer member 202, which simplifies the assembly of the spring and each component and the threading of the belt. The inner diameter of the spring can be reduced by the engagement of the inner end of the spring with the pin member, allowing a larger number of coils and a smaller outer diameter. The engagement of the pin member with the outer member is not limited to the retaining structure at the end of the pin member, but a similar retaining structure may be provided at the head portion.

Figure 9:
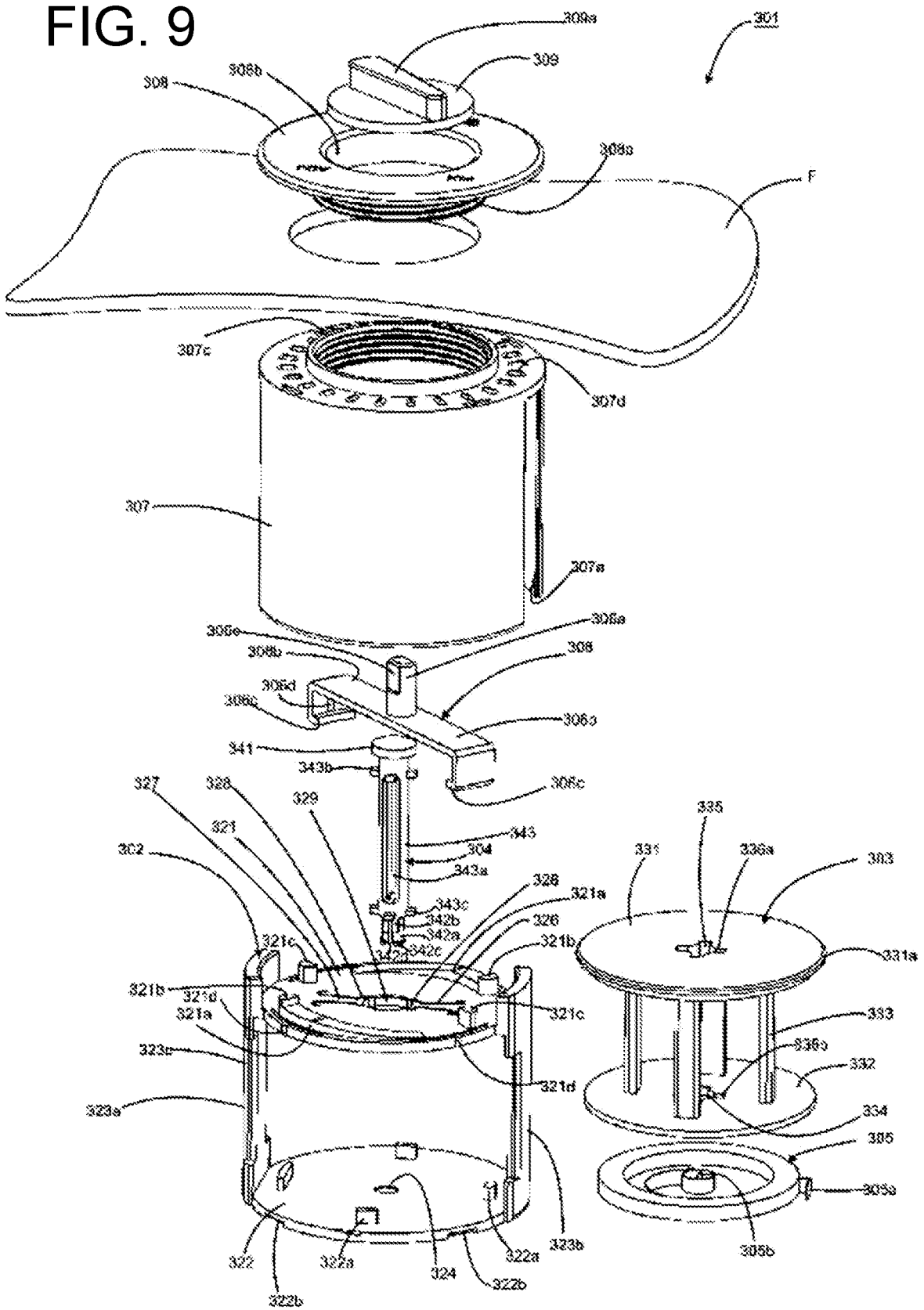
FIG. 9 is an exploded view of the belt retractor of the fourth embodiment.
Figure 10:
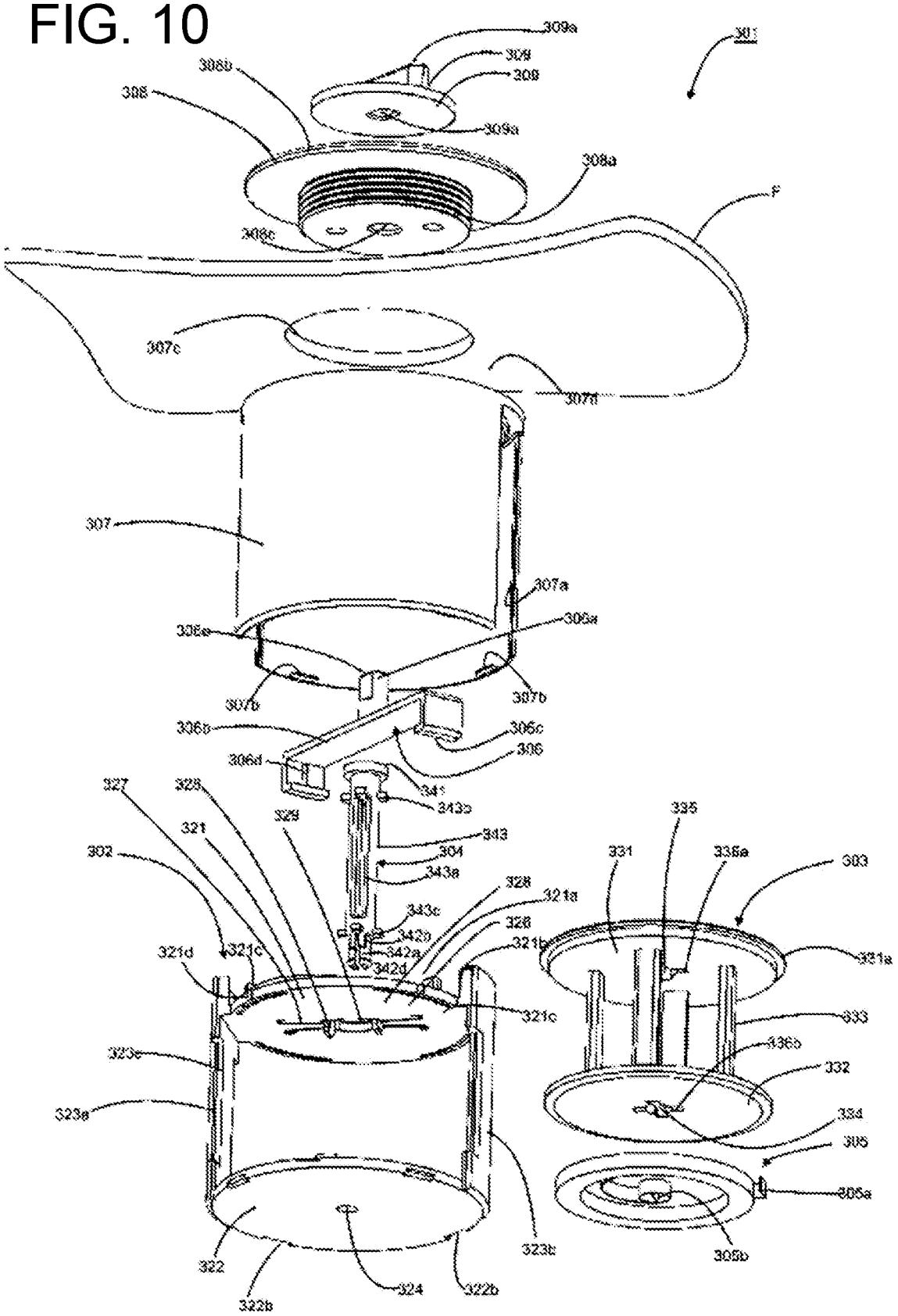
FIG. 10 is an exploded view of the belt retractor of FIG. 9 from another angle.

Next, the belt retractor 301 of the fourth embodiment is described using FIGS. 9 and 10. The belt retractor 301 is similar to the belt retractor 1 of the first embodiment, but differs significantly in that it is installed within the bag. For this reason, the belt retractor 301 is configured with a release mechanism so that it can be switched from outside the bag between the adjust mode, in which the belt length limit is changed, and the fix mode, in which the belt length limit is fixed.

The belt retractor 301 of the fourth embodiment comprises an outer member 302, a cylinder member 303 and a pin member 304 as core members rotatably provided inside the outer member 302, a spring 305 as a core member, and an elastic member forcing the cylinder member and the pin member 304 to rotate against the outer member 302. the U-shaped member 306 gripping the cylinder member 303 and the outer member 302 at the tips of the arms, the cover member 307 covering the U-shaped member 306 and the outer member 302, the holding member 308 screwed to the cover member 307 with the bag fabric F sandwiched therebetween, the spring 305 being held in a cut-out in the holding member 308 by the A-knob member 309 engaging the shaft of the U-shaped member 306 in the cut-out of the holding member 308. The parts other than the spring 305 are made of resin, but can also be made of metal.

The outer member 302 has an open side 321 and a bearing surface 322, which are a pair of disk-shaped surfaces provided perpendicular to the rotational axis of the pin member 304, and a pair of columnar portions 323*a* and 323*b* passed between the ends of these open side 321 and bearing surface 322 in a vertical columnar form. An opening 329 is formed, and a bearing hole 324 is provided at the center of the bearing surface 322 for rotatably bearing the pin member 304. The pair of columns 323*a* and 323*b* have cut-outes 323*c* on each side for the belt to pass through and guide the belt.

The open side 321 is disk-shaped, as described above, and has an opening 329 in the center. Since this opening 329 is a hole into which the pin member 304 is inserted and into which its head 341 can rotatably fit, it is circular with an inner diameter slightly larger than the head 341 of the pin member 304. Part of the arc of this circle is formed by a pair of projections 328. A pair of elastic portions 327 bridged by two pairs of slits 326 provided in the longitudinal direction of the open side 321 have elasticity derived from the resin material, and the protrusions 328 are provided at their tips. The elastic portions 327 and the projections 328 form a pressing portion. The protrusion 328 is a member for pressing the cylinder member 303 toward the bearing surface 322, and protrudes toward the bearing surface 322. As shown in FIG. 10, the side surface of the projection 328 has a slope surface 328*a*, and when the cylinder member 303 is assembled into the outer member 302 from the side, this slope surface 328*a* is pressed by the cylinder member 303, and the projection 328 is pushed outward by the elasticity of the elastic portion 327, so that the cylinder member 303 can smoothly enter the outer member 302.

The pair of pillar portions 323 are provided perpendicular to the open side 321 and the bearing surface 322. The pillars are not limited to one pair, but may be two pairs, etc., depending on the strength of the material and other factors.

At the center of the bearing surface 322 is a bearing hole 324, which is a circular through-hole for bearing the pin member 304. The bearing hole 324 is a circular through bearing hole for insertion of the tip 342 of the pin member 304. Two pairs of blocks 322*a* are provided near the periphery of the bearing surface 322 for engaging the outer end 305*a* of the spring 305, and also for restricting the periphery of the spring 305. The spring 305 is a spring having an inner end 305*b* bent and formed into an L-shape and an outer end 305*a* bent and formed into a U-shape.

The cylinder member 303 has a pair of circular surfaces, first surface 331 and second surface 332, corresponding to the open side 321 and bearing surface 322 described above, which are supported by four vertical column members 333 that support each other. The first and second faces 331 and 332 have first and second holes 335 and 334, respectively, drilled in their centers to receive the shaft 343 of the pin member 304, the inner diameters of which are slightly larger than the outer diameter of the shaft 343 of the pin member 304.

Four cutouts 336*a*, 336*b* are drilled in the first surface 331 and the second surface 332 adjacent to the first hole 335 and the second hole 334 through the front and back surfaces, respectively, for engaging the four head-side engaging convexities 343*b* and the four tip-side engaging convexities 343*c* of the pin member 304.

The pin member 304 has a brim-shaped head 341 provided at one end, a shaft portion 343 extending therefrom, a tip portion 342*a* provided at the other end, a spring engaging portion 342*b* provided in connection with the head side thereof, and a retaining clip 342*c* provided at the tip of the tip portion 342*a*. The pin member 304 has a slit 342*d* passing through the axis from the tip to the spring engaging portion 342*b* via the tip 342*a*. This slit 342*d* is for receiving the inner end 305*b* of the spring 305. The shaft 343 has a slit 343*a* along its length as an insertion portion for inserting the belt B. This slit 343*a* is not limited to a straight line, but may be formed to be wavy or the like, in which case it is easier to fix it in any position in the belt B. The shaft portion 343 also has four head-side engagement convexities 343*b* which protrude perpendicularly in the axial direction from the vicinity of the head 341, pass through the cutout 336, and possibly engage said cutout 336. In addition, the shaft portion 343 has four tip-side engagement convexes 343*c* that project perpendicularly in the axial direction from a position adjacent to the spring engaging portion 342*b*, pass through the cutouts 336*a*, 336*b*, and possibly engage the cutouts 336*b*. The spring engaging portion 342*b* is formed partially thinner than the body of the shaft 343 and is where the spring 205 is wound around. The tip 342*a* is even thinner and has an inner diameter slightly smaller than the inner diameter of the bearing hole 324, since it is the part that is inserted into the bearing hole 324. The retaining clip 342*c* at the end thereof is formed thicker than the inner diameter of the bearing hole 324 in a barb-like shape, and passes through the bearing hole 324 using the flexibility created by the slit 342*d*. After the elastic deformation is restored, the retaining clip 342*c* fits into the bearing bore 324 and the pin member 304 is not pulled out of the bearing bore 324.

The U-shaped member 306 disengages the engagement convexities 343*b*, 343*c* of the pin member 304 with the cutouts 336*a*, 336*b* of the cylinder member 303 by holding the cylinder member 303 on the open side 321 of the outer member 302. 343*c* to the cutouts 336*a*, 336*b* of the cylinder member 303 when disengaged.

The U-shaped member 306 has a pair of arms 306*b* extending in opposite directions perpendicular to the axis of rotation 306*a*, and claws 306*c* provided at the tips of these arms 406*b*. The tips of the claws are opposite the arms 306*b* and have the function of gripping the flange 331*a* provided on the periphery of the first surface 331 of the cylinder member 303.

The open side 321 of the outer member 302 has a pair of slope portions 321*a* having a slope projecting toward the U-shaped member 306 along the circumference of the outer surface. The pair of slope portions 321*a* are rotationally symmetric and have a gradually increasing clockwise slope. The arms 406*b* of the U-shaped member 306 climb up along this slope to pull the cylinder member 303 toward the outer member 302. The top of the slope portion 321*a* is flattened so that no restoring moment occurs when the U-shaped member 306 is rotated clockwise. It also has a non-rotation stop 321*b* that restricts rotation when rotated clockwise, and a non-rotation stop 321*c* that contacts the U-shaped member 306 when rotated counterclockwise. In order to keep the U-shaped member 306 in contact with these rotation stops 321*b* and 321*c*, an engaging concave portion 306*d* and a convex portion 321*d* are provided inside the U-shaped member 306 and around the periphery of the open face 321, and the convex portion 321*d* is connected to the periphery of the open face 321 via a pantograph-like elastic structure. This allows the U-shaped member 306 to be held in contact with the detents 321*b* and 321*c* with a certain amount of tension.

The rotational axis 306*a* of the U-shaped member 306 has an engaging portion 306*e* at its tip, which is inserted into and engaged with the engaging hole 309*a* of the knob member 309 through the hole 308*c* of the cover member 307. The knob member 309 has a knob portion 309*b* that can be rotated clockwise or counterclockwise to operate the U-shaped member 306. The U-shaped member 306 has the slope portion 321*a* in the clockwise rotated state, wherein the cylinder member 303 at the slope portion 321*a* is pulled against the open side 321 of the outer member 302 against the tension of the projection 328. Here, the pin member 304 does not move in the axial direction because the tip portion 342 is not pulled out of the bearing hole 324, and the engagement of the cut-out 336, the cut-out 336*b* with the head side engagement convex portion 343*b*, the tip side engagement convex portion 343*c* is released. As a result, the pin member 304 can rotate against the cylinder member 303, and the belt inserted into the slit 343*a* is wound around the pin member 303 by the rotational force of the spring 305 and is contained in the space defined by the pillar member 333 of the cylinder member 303. When the knob member 309 is rotated counterclockwise, the U-shaped member 306 descends the slope portion 321*a*, and when the belt is pulled a little and the pin member 303 is rotated, the cylinder member and the pin member 303 are engaged with the pin member 303 by the force of the projection 328 and become one body, so that the belt is wound around the outside of the pillar member 333 by the rotational force of the spring 305. The belt is wound around the outside of the column member 333 by the rotational force of the spring 305. In this manner, the length of the belt is adjusted inside the column member 333 and the remainder of the belt is wound outside the column member 333.

The cover member 307 covers the entire outer member 302 and the U-shaped member 306 from the outside and is open at the bottom. It has a notch 307*a* corresponding to the pillar members 323*a* and 323*b*, and four claws 307*b* engaging the four claw receiving grooves 322*b* of the outer member 302. The upper part has a threaded hole 307*c* that is screwed to the male thread 308*a* of the holding member 308 inserted and screwed through the round hole in the bag fabric F. The threaded hole 307*c* is surrounded by the male thread 308*a* of the holding member 308 inserted and screwed through the round hole in the bag fabric F. The threaded hole 307*c* is surrounded by a circular array of projections 307*d* which bite into the bag fabric F and prevent relative rotation. The retaining member 308 has a central cut-out 308*b* in which the knob 309 is received.

To assemble such a belt retractor 301, a jig (not shown) is inserted into the bearing hole 324 from the outside to hold the inner end 305*b* of the spring 305. Furthermore, when the spring 305 is wound, the outer end 305*a* is engaged with the block 322*a*. The jig should be a mechanism held by the bearing surface 322. If the inner end 305*b* is naturally centered, the jig may not be necessary. The cylinder member 303 is then fitted into the outer member 302 from the side. In this process, first the second side 332 is placed against the bearing surface 322 so that the second hole 334 corresponds to the bearing hole 324, and then the slope surface 328*a* of the projection 328 is pushed by the circumference of the first side 331, pushing the projection 328 outward by the elasticity of the elastic portion 327 while the first side 331 is parallel to the open side 321. Push it in so that the first face 331 becomes parallel to the open face 321. Then, the pin member 304 is inserted into the opening 329 and the first hole 335, and the tip 342*a* is inserted into the bearing hole 324, and the spring engaging portion and the tip engaging convex portion 343*c* are inserted into the second hole 334. Then, the retaining clip 342*c* is passed through the bearing hole 324 and is restored to function as a retaining clip. In this state, the jig is disengaged and the spring 305 attempts to rotate the pin member 304 by the restoring force. In this case, when the pressure on the projection 328 is released at the position where the head-side engagement concave portion 343*b* corresponds to the engagement concave portion 336*a*, or where the tip-side engagement concave portion 343*c* corresponds to the engagement concave portion 334*b*, the cylinder member 303 moves toward the bearing surface 322, the head-side engagement concave portion 343*b* engages with the engagement concave portion 336*a*, the tip-side engagement concave portion 343*c* engages with the engagement concave portion 334*b*, thereby integrating the cylinder member and the pin member 304 with the cylinder member 303. In this state, the strap is passed through the strap retractor 301 so that it enters from one of the column members 323*a*, passes between the column members 333, passes through the slit 326 from one side to the other, and exits to the other side or one of the column members 323*b* on the opposite side.

The U-shaped member 306 is then installed so that it is positioned outside the head 341 of the outer member 302 and the pin member 303, and is slid so that the claw 306*c* at its tip is positioned under the flange 331*a*. In addition, the cover member 307 is placed over the column member 323*b* so that the notch 307*a* corresponds to the notch 307*b*. The strap passes through the slot created between the cover member 307 by the notches 323*c* on either side of the column member.

In this state, the threaded opening 307*c* is aligned with the hole in the cloth F, and the holding member 308 is scored by the male thread 308*a* to attach it so as to pinch the cloth. The knob member 309 is attached to the rotary shaft 306*a* to complete the assembly.

With the assembly completed in this manner, the knob member 309 is normally rotated counterclockwise and the pin member 304 and the cylinder member 303 are integrated so that the strap belt is wound around the column 333 and pressed or extended against it by the spring 305. In this way, the strap belt can be wound. To adjust the length of the strap, turn the knob 309 clockwise while the strap is extended and not wound around the column 333. The pin member 304 can then rotate against the cylinder member 303, and when the strap belt is not pulled, the belt inserted in the slit 343*a* is wound around the pin member 303 by the rotational force of the spring 305 and is contained within the space defined by the pillar 333 of the cylinder member and the pin member 303. When the length of the strap belt is appropriately adjusted, turning the knob member counterclockwise changes the mode from the adjusting mode to the fixing mode, and the strap belt is wound around the pillar member 333. In this case, the extended length of the strap belt is limited.

Figure 11:
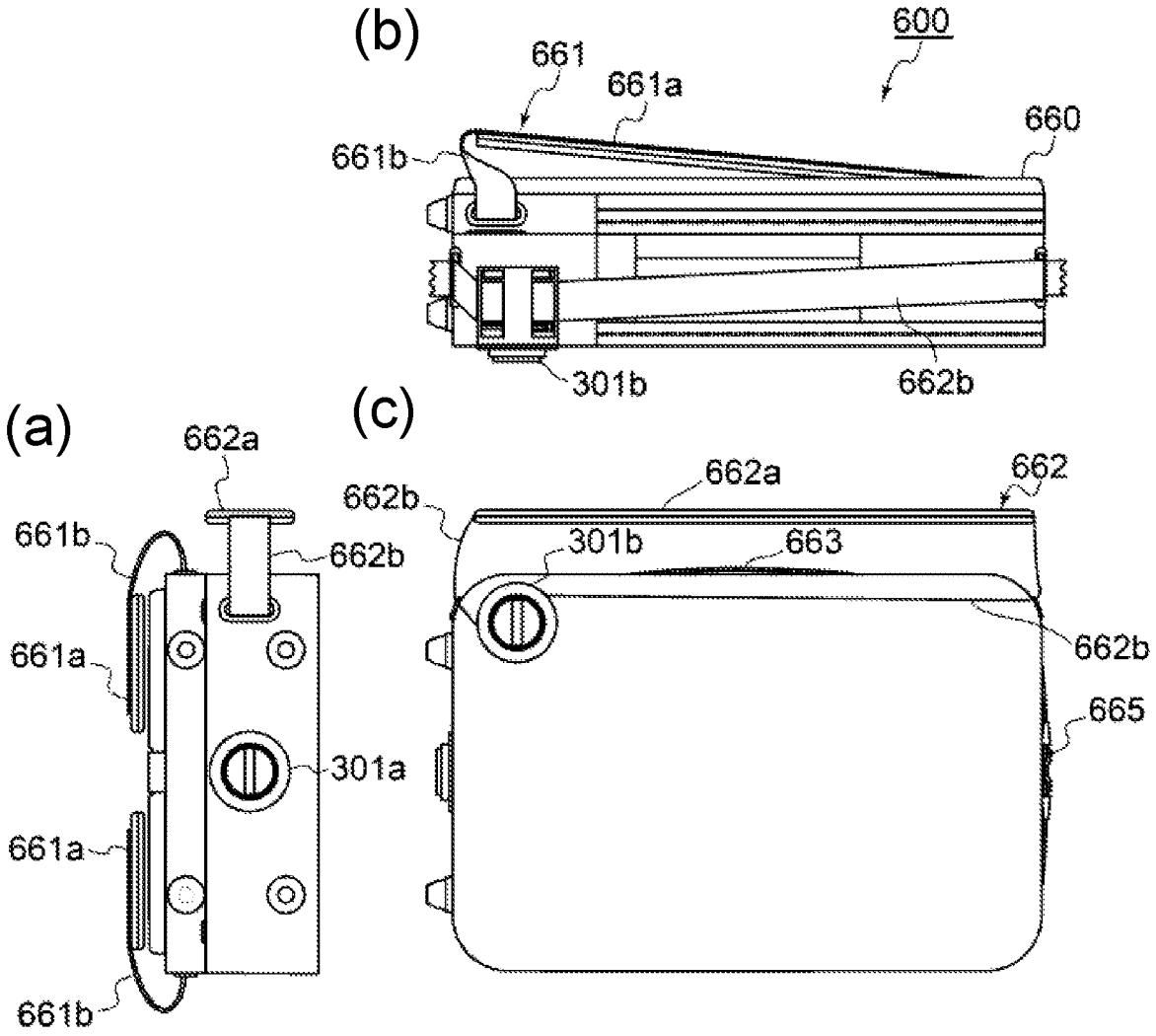
FIG. 11 is the belt retractor of FIG. 9 attached to a bag is shown in (a) a side view, (b) a top view, and (c) a front view.

The method of attaching such a belt retractor 401 to a bag will now be described. FIG. 11 shows three schematic views of a bag having such a belt retractor 301 attached thereto; FIG. 11(*a*) is a side view, (b) is a top view, and (c) is a front view. The bag 600 of the embodiment of the present invention comprises a main body 660, a backpack strap 661 for carrying the main body as a backpack, a shoulder strap 662 for carrying the main body on the shoulder as a shoulder bag, a handle 663 for gripping the main body in a hand-held manner, and an opening 665 which is opened and closed by a zipper.

The backpack strap 661 comprises a shoulder pad 661 a and a strap belt 661*b* which are sewn together at one end, and the shoulder pad 661*a* is sewn to the main body 660 at the other end. As shown in FIG. 11(*a*), the first belt retractor 301*a* is attached to the side fabric of the body 660 of the bag 600, that is, to the center of the bottom when the bag 600 is used as a backpack. Specifically, there is a circular hole in the fabric in this area, and the belt retractor 301*a* is attached to the bag 600 by placing the belt retractor 301*a* here from the inside of the bag and screwing the holding member 308 to the cover member 307 from the outside. In this state, the strap 661*b* passes through the strap retractor 301*a* and both ends are connected to the left and right shoulder pads 661*a*. The belt retractor 301 installed as described above winds and stores the strap belt 661*b* so that, as shown in FIG. 11, when the bag 600 is not being carried, the strap belt 661*b* is stored in the belt retractor 301*a* and the backpack straps 661 are integrated into the main body 660 and the backpack straps 661 do not hang down when the bag 600 is carried in a handheld manner using the handles 663 or used as a shoulder bag using the shoulder straps 662. Also, unlike conventional backpack straps, the length adjusting mechanism is incorporated in the belt retractor 301*a* so that the ends of the excess backpack straps do not hang down, and when used as a backpack, the backpack straps 661 extend to the set length. When used as a backpack, the backpack straps 661 can be extended to the set length. When adjusting the length, the bag 600 is worn as a backpack and the knob member 309 is turned clockwise to enter the adjustment mode. The bag 600 can be adjusted to the desired length by moving the bag 600 up and down and then turning the knob 309 counterclockwise to enter the fix mode, wherein the backpack straps are wound when the bag 600 is lowered and extended when the bag 600 is worn, but not beyond the previously determined length.

The shoulder straps 662 also include a shoulder pad 662*a* sewn to each end of a pair of strap bands 662*b* at the center of the length of the shoulder straps 662, wherein the strap band 662*b* passes within a second strap retractor 301*b*. The belt retractor 301*b* is placed in the front fabric corner of the bag 600 and, like the belt retractor 301*a*, is secured by pinching the fabric around the circular hole. The belt retractor 601 installed in this manner winds and stores the strap belt 662*b* so that, as shown in FIG. 11, when not worn on the shoulder, the strap belt 662*b* is stored and the shoulder strap 662 becomes an integral part of the main body 660 and can be used with the handle 663 When the bag 600 is carried in a handheld manner using the handle 663 or used as a backpack using the backpack strap 661, the shoulder straps 662 do not hang down. In addition, unlike conventional shoulder straps, the length adjustment mechanism is incorporated in the strap retractor 301*b* so that no adjustment buckles or metal fittings are required to make the shoulder straps detachable. In addition, the shoulder pad 662*a* can be sewn to the center of the shoulder strap, thereby avoiding problems that tend to occur with conventional shoulder straps, such as the shoulder pad shifting from the center or turning inside out. When used as a messenger bag, the 662*a* can be used as a shoulder strap. When used as a messenger bag, the 662 messenger bag strap extends to the specified length.

When the bag is carried on the back with the strap retractor 301 set on the shoulder straps and backpack straps in this manner, the strap belt is released from its storage against the force of the spring 305 by the weight of the bag, and the strap belt is extended. If the strap is found to be too long, the length of the strap extension can be limited by adjusting the strap retractor 301. As described above, the belt retractor 301 of the fourth embodiment automatically winds the strap belt so that the strap belt does not get in the way, the extended length of the strap belt can be adjusted, the end of the strap belt does not stick out, and the belt retractor itself is built into the bag. The belt retractor itself can also be built into the bag to realize a bag that does not get in the way. The belt retractor 301 of the fourth embodiment is an example, and various changes can be made to the method to achieve the same effect. For example, the number and shape of the column members of the outer member and the cylinder member, the shape and position of the pressing portion can be changed as needed, and the engagement relationship between the pin member and the cylinder member and the pin member can also be reversed. In addition to the spring, elastic members such as string springs and rubber can be used. Both ends of the spring can be engaged with the outer member and the pin member. It can function as a retractor even without a cover member, and a structure other than the U-shaped member and the knob structure can be used to switch between the adjusting mode and the fixing mode to slide the cylinder member. Furthermore, when the core member is composed of a single member, at least the strap belt can be automatically wound up to realize a bag in which the strap belt does not get in the way, even if a separate mechanism is required with respect to the extended length adjustment.

The strap retractor of the present invention is not limited to bags, but can be used for various straps, such as straps for musical instruments, hip bag straps, seat belts, etc.

Figure 12:
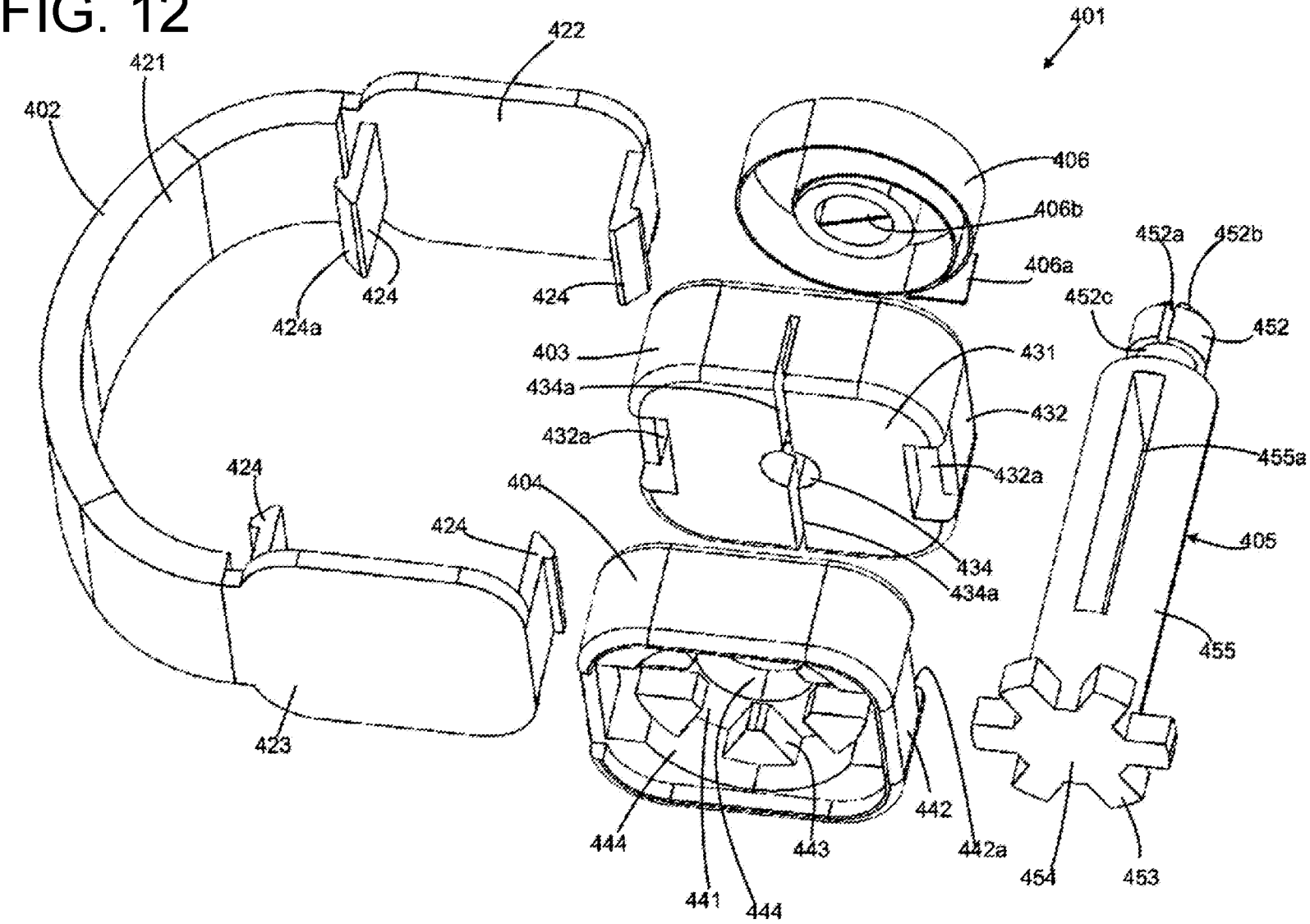
FIG. 12 is an exploded view of the fifth embodiment of the belt retractor.

For example, FIG. 12 shows a diagram of a fifth embodiment of the belt retractor of the present invention for use on a helmet strap. Conventionally, bicycle helmets are worn on the head by engaging the connectors provided at the ends of the left and right straps together under the chin and adjusting the length by the adjustment buckle. However, children in particular can get their skin caught in the buckles, and it is inconvenient to put the helmet on in a hurry during a race because it requires the use of both hands. There is also the inconvenience of having to perform the mounting and length adjustment operations separately.

Therefore, the belt retractor 401 of the fifth embodiment comprises an arm member 402 as an outer member and a pair of cap members, a spring storage cap 403 and a control cap 404, a pin member 405 as a core member rotatably provided inside the outer member and a pin member 405 as a core member as the spring storage cap member 403, and a spring 406 as an elastic member that is forced to rotate the spring 406 against the spring storage cap member 403. The parts other than the spring 405 are made of resin, but may be made of metal.

The arm member 402 has a U-shaped arm portion 421 and a spring storage cap receiving portion 422 and a control cap receiving portion 423, which are flat surfaces provided opposite each end of the arm portion 421. The arm portion 421 has flexibility derived from its shape and material, and is selected to have a rectangular or elliptical cross-sectional structure. The spring storage cap receiving portion 422 and the control cap receiving portion 423 are rectangular planes corresponding to the spring storage cap 403 and the control cap 404, respectively, and have a pair of engagement pawls 424. The tips of the engagement pawls 424 are provided with a caulk 424*a* to prevent loosening.

The spring storage cap member 403 has a bearing surface 431, which is an abbreviated rectangular plane provided perpendicular to the rotational axis of the pin member 405, and a wall surface 432, which is perpendicular from the four sides of the bearing surface 431 to the outer direction parallel to the rotational axis. In the center of the bearing surface 431, there is a bearing hole 434 which is a circular through-hole for bearing the pin member 405. The bearing hole 434 is a circular through bearing hole for inserting the tip 452 of the pin member 405. A slit 434*a* is jointly provided above and below the bearing hole 434. This is a slit that promotes flexible deformation to facilitate acceptance of the tip 452 of the pin member 405. Between the bearing surface 431 and the wall surface 432, a pair of left and right engagement holes 432*a* are provided to engage the engagement claws 424 of the arm member 402. Although not shown in the drawing, a block for engaging the outer end 406*a* of the spring 406 is provided on the outside of the bearing surface 431 in the axial direction near the outer edge. The spring 406 is a spring having an inner end 406*b* bent and formed into an L-shape and an outer end 406*a* bent and formed into a U-shape.

The control cap 404 has a bearing surface 441, which is an abbreviated rectangular surface provided perpendicular to the rotational axis of the pin member 405, and wall surfaces 442 perpendicular to the rotational axis in an outward direction parallel to the rotational axis from four sides of this bearing surface 441. At the center of the bearing surface 441 is a bearing hole 444, which is a circular through-hole for bearing the pin member 405. Around the bearing hole 444 and on the axially outer side of the bearing surface 441 are six engagement concave portions 443 which receive six engagement convex portions 453 provided on the head of the pin member 405 in a splined configuration perpendicular to the axis of rotation. Between the bearing surface 441 and the wall surface 442, a pair of engagement holes 442*a* are provided on the left and right sides to engage the engagement claws 424 of the arm member 402. Outside the engagement concave portion 443 in the axial direction, there is a rotation space 444 in which the engagement convex portion 453 rotates without being obstructed.

The pin member 405 has a splined head 454 provided at one end, a shaft portion 455 extending in connection therewith, and a tip portion 452 provided at the other end. The tip 452 has a slit 452*a* on the tip side and is provided with flexibility to hold the inner end 406 of the spring 405 and facilitate insertion into the bearing hole 434. The tip of the tip 452 is chamfered 452*b* to form a taper and pointed tip to facilitate insertion into the bearing hole 434. The bearing contact portion 452*c*, which contacts the bearing, has a small radius to prevent the tip 452 from falling out after insertion into the bearing bore 434. The shaft portion 455 has a slit 455*a* along its longitudinal direction as an insertion portion for inserting a belt. This slit 455*a* is not limited to a straight line, but may be formed to be wavy or the like, in which case it is easier to fix it in any position in the belt. The head 454 also has six engagement convexities 453 projecting perpendicular to the axial direction.

The following describes how to assemble the belt retractor 401 with the above configuration. First, the pin member 405 is inserted into the bearing hole 444 of the control cap 404, and then the tip 452 of the pin member 405 is inserted into the bearing hole 434 of the spring storage cap 403. In this case, the bearing surface 431 is flexibly deformed by the slit 434*a*, and the tip 452 is flexibly deformed by the slit 452*a* to allow insertion.

The inner end 406*b* and the outer end 406*a* of the spring 406 are then clamped between the slit 452*a* and the block on the bearing surface 431.

Then, the control cap 404 and the spring storage cap 403 are inserted into the engagement holes 442*a* and 432*a* with the engagement pawls 424 and are pushed in until the pawls 424*a* exposes, and then the control cap 404 and the spring storage cap 403 are secured to the spring storage cap receiving portion 422 and the control cap receiving portion 423. At this time, due to the dimensions of the arm member 402, the engaging convex portion 453 is engaged with the engaging concave portion 443. In this state, the pin member 405 does not rotate. Therefore, when the spring storage cap receiving portion 422 and the control cap receiving portion 423 are pinched and pressed from the outside, the pin member 405 is pushed by the spring storage cap 403 and further into the control cap 404, thereby disengaging the engagement convex portion 453 and the engagement concave portion 443, and the pin member's the splined head 454 of 405 moves into the rotational space 444. The head 454 then becomes rotatable, allowing the pin member 405 to be rotated against the force of the spring 406. When the pressure on the spring containment cap receiving portion 422 and the control cap receiving portion 423 is released when the pin member 405 has been sufficiently rotated, the engagement convex portion 453 and the engagement concave portion 443 are again engaged, and the pin member 405 is not rotated. The chinstrap of the helmet is then passed through the slot 455*a*. The strap is connected to the left side of the helmet from the right side through the strap retractor 401 without any break. In this state, when the spring storage cap receiver 422 and the control cap receiver 423 are pinched and pressed from outside, the pin member 405 rotates according to the force of the spring 406 and the belt is wound. Thus, the strap can be wound by simply pinching the strap retractor 401, and the length of the helmet strap can be adjusted accordingly. By simply releasing the belt retractor 401, the length of the belt is fixed so that it does not stretch when the helmet is put on, nor does it bite into the chin and cause pain or pinch the skin. When the arm member 402 is worn so that it is positioned outwardly against the strap, the arm member 402 can also avoid hitting the face.

As described above, the belt retractor of the present invention can be used for various purposes. Of course, the object to be wound can be not only a flat belt, but also a string. Of course, the belt retractor 401 of the fifth embodiment can be used for a bag, and the belt retractor of other embodiments can be used for a helmet. The belt retractor 401 of the fifth embodiment has been disengaged from the pin member and the outer member by pushing, but conversely may be disengaged and engaged by pushing under normal conditions. A latch may be used to allow rotation of the core member with respect to one side only.

DESCRIPTION OF REFERENCE CHARACTERS

1,101,201,301,401 Belt retractor
2,102,202 Outer member
3,103,203 Cylinder member
4,104,204 Pin member
5,105,205,305,406 Spring

What is claimed is:

1. A belt retractor, comprising:

an outer member;

a core member rotatably provided inside said outer member; and an elastic member provided between said core member and said outer member, said core member having an insertion portion through which a strap belt is inserted, wherein said elastic member is provided at a position axially offset from said insertion portion in said core member, said strap belt being wound around said core member and stored between said core member and said outer member when said core member is rotated against said outer member in accordance with said force of said elastic member while said insertion portion grips said strap belt, and wherein said core member comprises a cylinder member and a pin member provided inside said cylinder member and having said insertion portion, said pin member and said cylinder member having an engaging portion capable of engaging with each other so as to rotate together to wind said strap belt around said cylinder member and being rotatable relative to each other when the engagement in said engaging portion is released so that said strap belt is wound around said pin member.

2. The belt retractor according to claim 1, wherein said engagement portion comprises a convex engagement portion on said pin member and a concave engagement portion on said cylinder member.

3. The belt retractor according to claim 1, wherein said elastic member is a spring wound around the same axis of rotation as said core member in a radially overlapping manner, and wherein the inner end of said spring is engaged with said outer member and the outer end of said spring is engaged with said cylinder member.

4. The belt retractor according to claim 1, wherein said elastic member is a spring wound around the same axis of rotation as said core member in a radially overlapping manner, and wherein the inner end of said spring is engaged with said pin member and the outer end of said spring is engaged with said outer member.

5. The belt retractor according to claim 1, wherein when said cylinder member is assembled into said outer member, there is a gap in the axial direction between said outer member and said cylinder member, and wherein said outer member has a pressing portion which presses said cylinder member in the direction in which said engaging portion engages.

6. The belt retractor according to claim 5, wherein said pressing portion is provided by a cutout in a portion of said outer member and has an elastic portion and a protruding portion.

7. The belt retractor according to claim 1, wherein said pin member is rotatably engaged with said outer member.

8. The belt retractor according to claim 1, wherein said core member and said outer member have an engagement portion engageable with each other and are rotatable with each other when the engagement in said engagement portion is disengaged, and are integrated when engaged.

9. The belt retractor according to claim 8, wherein said core member and said outer member are engaged with each other when pressed by elastic deformation of said outer member, and when disengaged against said pressing, said core member rotates with respect to said outer member to wind the belt strap.

10. The belt retractor according to claim 1, wherein a disengaging mechanism is provided for disengaging said engaging portion by moving said cylinder member in the axial direction against the force of said pressing portion.

11. A backpack having a backpack strap, wherein said belt retractor according to claim 1 is provided on the backpack strap.

12. A shoulder bag having shoulder straps, wherein said belt retractor according to claim 1 is provided on the shoulder straps.

13. The shoulder bag according to claim 12, wherein said shoulder strap has a shoulder pad at the center of the longitudinal direction, and said belt retractor is provided at the center of the longitudinal direction on both sides between said shoulder pads.

* * * * *